US007434359B2

(12) United States Patent
Geiger

(10) Patent No.: US 7,434,359 B2
(45) Date of Patent: Oct. 14, 2008

(54) CONSTRUCTING GEODESIC DOMES WITH PANELS

(76) Inventor: David S. Geiger, 13409, Fernando Ave., Apple Valley, MN (US) 55124

( * ) Notice: Subject to any disclaimer, the term of this patent is extended or adjusted under 35 U.S.C. 154(b) by 424 days.

(21) Appl. No.: 10/919,689

(22) Filed: Aug. 17, 2004

(65) Prior Publication Data

US 2005/0022461 A1 Feb. 3, 2005

Related U.S. Application Data

(63) Continuation-in-part of application No. 10/355,387, filed on Jan. 30, 2003, now Pat. No. 6,996,942.

(51) Int. Cl.
*E04B 7/08* (2006.01)

(52) U.S. Cl. ..... 52/81.3; 52/650.2; 52/656.9; 446/116; 446/126

(58) Field of Classification Search ..... 52/81.3, 52/81.4, 81.1, 655.1, 655.2, 656.9, 650.2, 52/652.1, 656.7, 81.2, DIG. 10; 446/116, 446/126; 403/172
See application file for complete search history.

(56) References Cited

U.S. PATENT DOCUMENTS

| | | | | | |
|---|---|---|---|---|---|
| 2,682,235 | A | * | 6/1954 | Fuller | 52/81.3 |
| 2,978,074 | A | * | 4/1961 | Schmidt | 52/81.2 |
| 3,137,371 | A | | 6/1964 | Nye | |
| 3,186,522 | A | | 6/1965 | McCauley | |
| 3,203,144 | A | * | 8/1965 | Fuller | 52/81.4 |
| 3,333,375 | A | | 8/1967 | Johnston | |
| 3,810,336 | A | | 5/1974 | Sadao | |
| 3,881,284 | A | | 5/1975 | Martin | |
| 3,894,367 | A | * | 7/1975 | Yacoboni | 52/81.2 |
| 3,909,994 | A | | 10/1975 | Richter | |
| 3,945,160 | A | * | 3/1976 | Grosser et al. | 52/81.4 |
| 4,009,543 | A | | 3/1977 | Smrt | |
| 4,012,872 | A | | 3/1977 | Stolpin | |
| 4,092,810 | A | * | 6/1978 | Sumner | 52/81.4 |
| 4,187,613 | A | * | 2/1980 | Ivers et al. | 33/32.1 |
| 4,244,152 | A | | 1/1981 | Harper, Jr. | |
| 4,245,809 | A | * | 1/1981 | Jackson | 249/15 |
| 4,262,461 | A | * | 4/1981 | Johnson et al. | 52/81.3 |
| 4,287,690 | A | * | 9/1981 | Berger et al. | 52/81.4 |

(Continued)

OTHER PUBLICATIONS

"The Vacation Home You Store In Your Garage", Popular Science, p. 26, Oct. 2002.

(Continued)

*Primary Examiner*—Anita M King
(74) *Attorney, Agent, or Firm*—Shumaker & Sieffert, P.A.

(57) ABSTRACT

Techniques are described for constructing geodesic dome structures. For example, a method includes connecting a set of panels to form a geodesic dome. The panels have surface contours that conform to a surface contour of a geodesic dome having a dimension larger than a dimension of the geodesic dome formed by the panels. Another method includes attaching flanges to a set of permanent structure members that form a permanent geodesic dome structure. The method further includes fastening a set of panels to the flanges. The panels enclose the geodesic dome structure to form the geodesic dome. The techniques described may allow the construction of a geodesic dome structure of precisely controlled dimensions with relatively small numbers of people and little strenuous labor.

21 Claims, 21 Drawing Sheets

U.S. PATENT DOCUMENTS

| | | | | | |
|---|---|---|---|---|---|
| 4,309,852 | A | | 1/1982 | Stolpin | |
| 4,400,927 | A | * | 8/1983 | Wolde-Tinase | 52/745.08 |
| 4,625,472 | A | * | 12/1986 | Busick | 52/81.4 |
| 4,750,807 | A | * | 6/1988 | Chamayou dit Felix | 52/81.2 |
| 4,907,382 | A | * | 3/1990 | Schwam | 52/81.1 |
| 5,261,194 | A | * | 11/1993 | Roberts | 52/81.1 |
| 5,452,555 | A | | 9/1995 | Lee | |
| 5,560,151 | A | | 10/1996 | Roberts | |
| 5,732,518 | A | * | 3/1998 | Roberts | 52/245 |
| 5,916,097 | A | * | 6/1999 | Markuten | 52/81.2 |
| 5,996,288 | A | | 12/1999 | Aiken | |
| 6,098,347 | A | * | 8/2000 | Jaeger et al. | 52/81.3 |
| 6,108,984 | A | * | 8/2000 | Davidson | 52/81.1 |
| 6,192,634 | B1 | * | 2/2001 | Lopez | 52/81.2 |
| 6,240,694 | B1 | * | 6/2001 | Castano | 52/653.1 |
| 6,658,800 | B2 | * | 12/2003 | Monson et al. | 52/81.1 |
| 6,722,086 | B2 | * | 4/2004 | Boots | 52/81.3 |
| 6,748,962 | B2 | | 6/2004 | Miller | |
| 6,996,942 | B2 | * | 2/2006 | Geiger | 52/81.3 |

OTHER PUBLICATIONS

"Rock-Solid Framing Technique", Mark Powers, This Old House Magazine, p. 20, Nov. 2003.

"Design: Yurts Come Out of the Woods", Ashley Chapman, Wall Street Journal, Aug. 29, 2003.

"A New Product Line From The Succussful Canadian Plastics Producer: Royal Homes For Developing Nations Help Cut Costs", Andy Turnbull, Automated Builder, pp. 14-15, Oct. 2002.

*Dome Book 2*, by Pacific Domes, pp. 108-109, May 1971.

J. Baldwin, "Bucky Works—Buckminster Fuller's Ideas for Today", 1996, pp. 207-216.

"Wood Construction Connectors", Simpson Strong-Tie Co., Inc., 2001, Catalog C-2002.

"Discover the Strength", Reaves Building Systems, Brochure.

* cited by examiner

CONSTRUCTING GEODESIC DOMES WITH PANELS

This application is a Continuation-In-Part of U.S. application Ser. No. 10/355,387, filed Jan. 30, 2003 now U.S. Pat. No. 6,996,942, the entire content of which is incorporated herein by reference.

TECHNICAL FIELD

The invention relates to geometrically shaped buildings, and more particularly, to constructing geodesic domes.

BACKGROUND

A geodesic dome is a type of structure constructed with straight elements that form interlocking polygons. The structure is comprised of a complex network of polygons, usually triangles, which form a roughly spherical surface. The more complex the network of polygons, the more closely the dome approximates the shape of a sphere.

There have been many different techniques studied to construct a geodesic dome, including constructing the geodesic dome with a framework or without a framework. The techniques include using permanent rods and connectors as a framework, using interlocking panels as a framework, and using interlocking panels without a framework. The techniques that use frameworks may further include enclosing the framework. Many of these techniques may involve hard labor and machinery to lift heavy materials. The geodesic domes may take weeks or even months to construct.

SUMMARY

In general, the invention is related to techniques for constructing geodesic dome structures. The techniques may be used, for example, for efficiently constructing geodesic domes with relatively small numbers of people and little strenuous labor. As described in detail, a set of panels is connected to form a geodesic dome. The panels have surface contours that conform to a surface contour of a geodesic dome having a dimension larger than a dimension of the geodesic dome formed by the panels. The panels may comprise wood, plastic, fiberglass, metal, resin, or a like material. In some cases, both interior and exterior panels may be connected to form the geodesic dome. The geodesic dome structure may then be insulated by placing insulating material in a cavity created between the interior and exterior panels.

A set of permanent structure members form a permanent geodesic dome structure. Flanges are attached to the permanent structure members to connect the panels to the permanent structure members. In that way, the panels enclose the permanent geodesic dome structure to form the geodesic dome. The flanges may comprise a curvature to match the surface contour of the panels, which provides a weather tight seal for the geodesic dome structure. The permanent structure members may consist of wood, metal, plastic, fiberglass, or the like. Alternatively, a curing material, such as a spray-on cement or epoxy, may be applied to the geodesic dome structure. In some embodiments, the permanent structure members may enclose the geodesic dome structure.

A set of temporary spacers and a set of connectors may be assembled to form the geometries of the geodesic dome. More particularly, the temporary spacers reference the connectors with respect to one another in space to form the geometries of the geodesic dome structure. For example, the set of temporary spacers may be fastened to the connectors with fasteners such as nails, screws, bolts, hooks, or clamps. Alternatively, one or more strands of wire may be attached between the connectors to create a wire mesh. The wire mesh may be erected to form the geometries of the geodesic dome. In this manner, the strands of woven wire act as the temporary spacers. In some embodiments, the wire mesh may be erected with the aid of the set of temporary spacers, such that the strands of wire guide the assembly of the temporary spacers and the connectors to ensure proper alignment. The set of permanent structure members may then be fastened to the set of connectors to form the permanent geodesic dome structure.

The temporary spacers may be removed from the geodesic dome structure. For example, the temporary spacers may be removed as the permanent structure members are fastened to the connectors. In the case in which the temporary spacers are removed, the temporary spacers may be attached to another set of connectors to form the geometries of another geodesic dome. In this fashion, the construction of geodesic dome structures may be done in an assembly line fashion. However, the temporary spacers may remain fastened to the connectors and become a passive part of the geodesic dome.

In one embodiment, the invention provides a method of constructing a geodesic dome. The method comprises connecting a set of panels to form the geodesic dome. The panels have surface contours that conform to a surface contour of a geodesic dome having a dimension larger than a dimension of the geodesic dome formed by the panels.

In another embodiment, the invention provides an apparatus comprising a set of panels connected to form a geodesic dome. The panels have surface contours that conform to a surface contour of a geodesic dome having a dimension larger than a dimension of the geodesic dome formed by the panels.

In another embodiment, the invention provides another method of constructing a geodesic dome. The method comprises attaching flanges to a set of permanent structure members that form a permanent geodesic dome structure. The method further includes fastening a set of panels to the flanges to enclose the geodesic dome structure to form the geodesic dome.

In a further embodiment, the invention provides an apparatus comprising a set of permanent structure members, flanges, and a set of panels. The set of permanent structure members form a permanent geodesic dome structure. The flanges attach to the permanent structure members. The set of panels fasten to the flanges to enclose the geodesic dome structure to form the geodesic dome.

The invention can provide a number of advantages. In general, the invention provides techniques for constructing geodesic domes with relatively small numbers of people and little strenuous labor. Further, the geodesic domes may be constructed in a relatively short period of time, e.g., hours or days. Constructing geodesic domes with small numbers of people, little strenuous labor, and in a short amount of time may be particularly useful for providing shelter for those who have lost homes from natural disasters, wars, or similar catastrophic events. In addition, enclosing the geodesic dome structure with panels creates a more permanent structure by sheltering the interior of the dome and bracing the permanent structure members that form the dome structure. A contoured panel comprises a self-supporting member and adds structural support to the geodesic dome. Furthermore, the geodesic dome may be insulated by placing insulating material between interior and exterior panels. A geodesic dome enclosed with panels fastened to flanges may include a weather tight seal against wind and precipitation.

Further, the pieces of the geodesic dome, i.e., the temporary spacers, the connectors, the permanent structure members, the flanges, and the panels may come in a kit. The pieces may be coded by color and/or symbol to allow easy construction of the geodesic dome. For example, a person may construct the geodesic dome by following picture guides to assemble the coded pieces. Also, the pieces of the geodesic dome may be constructed of materials that are cheap to produce in order to reduce the cost of the kit. The temporary spacers and other components may be manufactured to extremely small tolerances, thus assuring the completed domes will approach the theoretical geometries of the desired dome, in turn, increasing the stability of the dome. The fine precision in manufacturing the components of the dome also promotes ease of assembly.

The details of one or more embodiments of the invention are set forth in the accompanying drawings and the description below. Other features, objects and advantages of the invention will be apparent from the description and drawings and from the claims.

DETAILED DESCRIPTION

Figure 1:
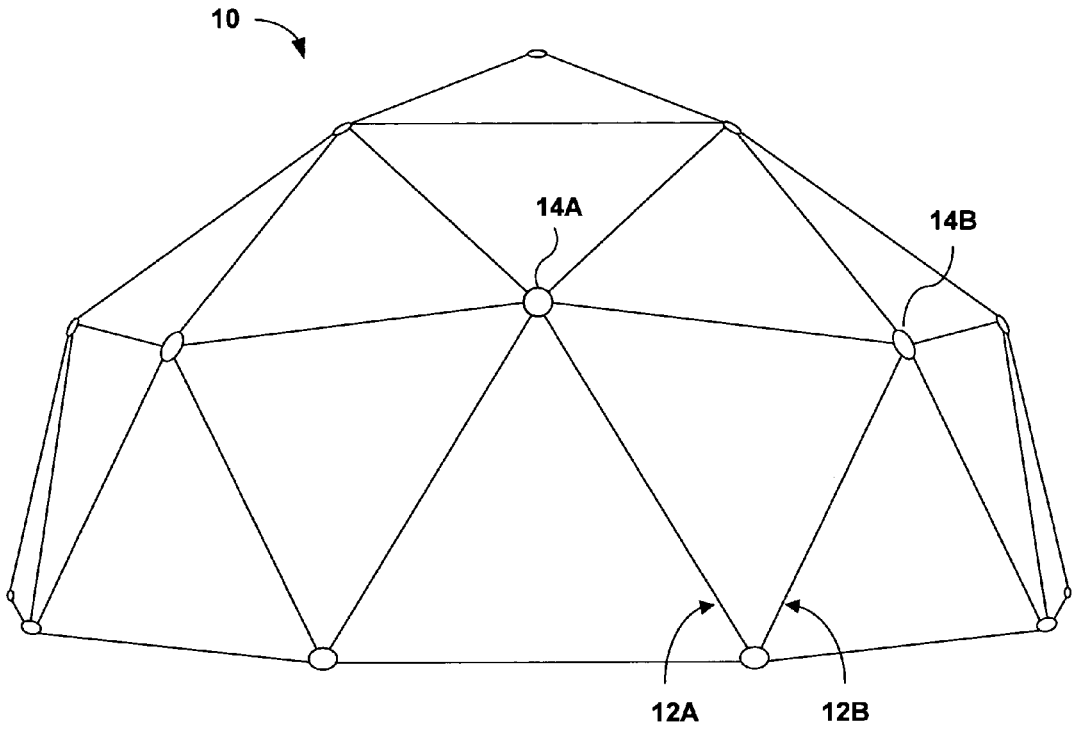
FIG. 1 is a schematic diagram illustrating a set of connectors referenced with respect to one another in space by a set of temporary spacers to form the geometries of a geodesic dome structure.

FIG. 1 is a schematic diagram illustrating a set of connectors 14 referenced with respect to one another in space to form the geometries of a geodesic dome structure 10. For ease of illustration, only connectors 14A and 14B are labeled on FIG. 1. A set of temporary spacers 12 is fastened to a set of connectors 14 to reference connectors 14 with respect to one another in space, forming the geometries of geodesic dome 10. Temporary spacers 12 may be fastened to connectors 14 with fasteners such as hooks, screws, bolts, nails, clamps, or the like. For ease of illustration, only temporary spacers 12A and 12B are labeled on FIG. 1. Temporary spacers 12 may comprise variable spacers that adjust to different lengths.

Temporary spacers 12 may be constructed of a rigid, yet lightweight material such as plastic, metal, wood, or the like. In the embodiment shown in FIG. 1, temporary spacers 12 are formed in the shape of rods or struts. However, temporary spacers 12 may be formed in the shape of any polygon or other shape that will define and hold the geometries in space until the desired geometries are fixed permanently in space. All temporary spacers 12 of geodesic dome structure 10 need not be the same size. For example, temporary spacers 12A may be a different length than temporary spacers 12B.

Connectors 14 are constructed from materials such as metal, plastic, or the like. Connectors 14 may be constructed to fasten to any number of temporary spacers 12. In the embodiment shown in FIG. 1, connectors 14 comprise a circular shape. Connector 14A fastens to six of temporary spacers 12, whereas connector 14B fastens to five of temporary spacers 12. In some embodiments, connectors 14A and 14B comprise substantially identical connectors regardless of a number of spacers that fasten to the respective connectors. Connectors 14 may also take the shape of numerous polygons depending on the number of temporary spacers 12 that fasten to connector 14. Connector 14 may be a ring-like piece, much like a link of a chain. Temporary spacers 12 may attach to one of connectors 14. Temporary spacers 12 may rotate around the connector to seek an appropriate angle between spacer 12 and connector 14.

Figure 2A:
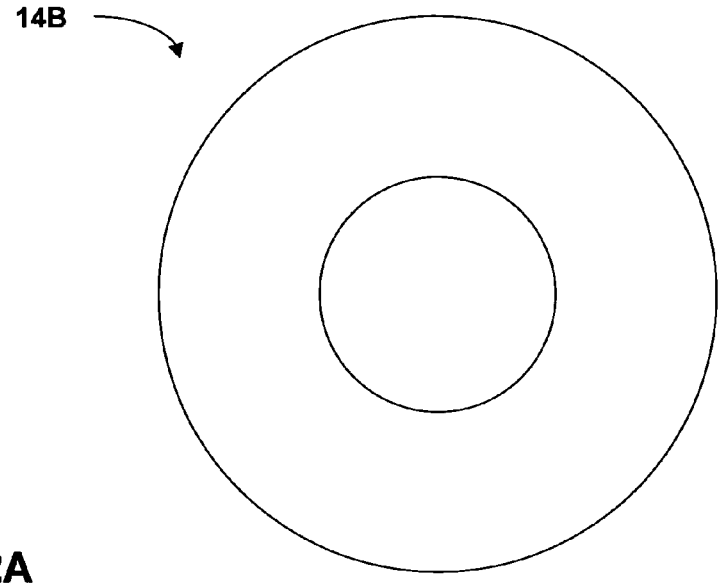
FIG. 2A is a schematic diagram illustrating a connector used to construct the geometries of a geodesic dome structure.

FIG. 2A is a schematic diagram illustrating a connector 14B used to construct the geometries of a geodesic dome structure 10. FIG. 2A shows a top view of connector 14B. The top view of connector 14B shows that connector 14B takes the shape of a circular ring. Connector 14B may be formed of one solid piece of material. Alternatively, connector 14B may be formed of multiple pieces of material that fit together to form connector 14B.

Figure 2B:
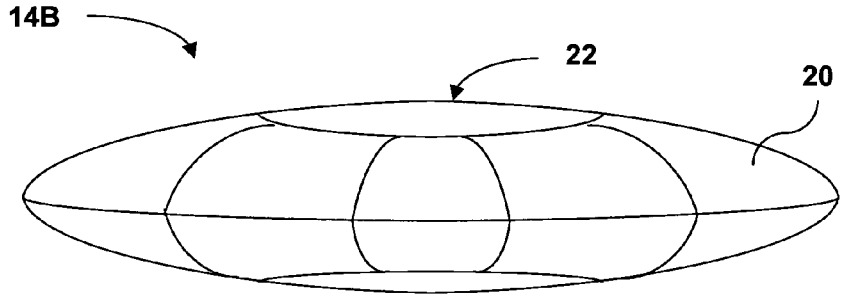
FIG. 2B shows a side view of the connector of FIG. 2A.

FIG. 2B shows a side view of connector 14B. The side view of connector 14B shows an outer shell 20 and an opening 22 of connector 14B. FIG. 2B also shows that connector 14B comprises a surface contour, as opposed to being flat. The contour allows straight structures to be attached to connector 14B to form the structure of dome 10. Alternatively, connector 14B may be flat and the attaching structures may have a contour. The contour may be different depending on the shape of connector 14B. Furthermore, the contour may be different depending on the type of dome 10 that is to be constructed. For example, a dome 10 with a larger radius may have a smaller surface contour.

Spacers and/or permanent structure members may attach to connector 14B via opening 22 using hooks or the like. Spacers, for example, may rotate or pivot around connector 14B to assume an appropriate angle between the spacer and connector 14B. The necessary angle between the spacers and/or permanent structure members and connector 14B may vary depending on the geometries of a geodesic dome 10, such as diameter, circumference, and the like.

Figure 2C:
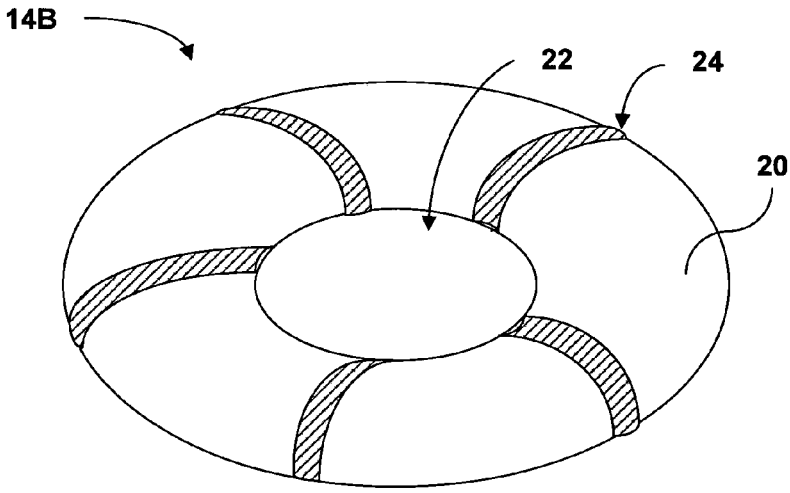
FIG. 2C shows an embodiment of the connector of FIG. 2A.

FIG. 2C shows an embodiment of connector 14B. Connector 14B includes outer shell 20, opening 22, and guides 24. In the embodiment shown in FIG. 2C, guides 24 separate connector 14B into five regions to appropriately attach five spacers and/or permanent structural members around connector 14B. As shown in FIG. 1, connector 14B receives five temporary spacers 12 and connector 14A receives six temporary spacers 12. Connector 14A may include guides to divide connector 14A into six attachment regions. In other embodiments, connectors may receive any number of spacers and/or permanent structure members necessary to define the geometries of a geodesic dome structure.

Figure 3:
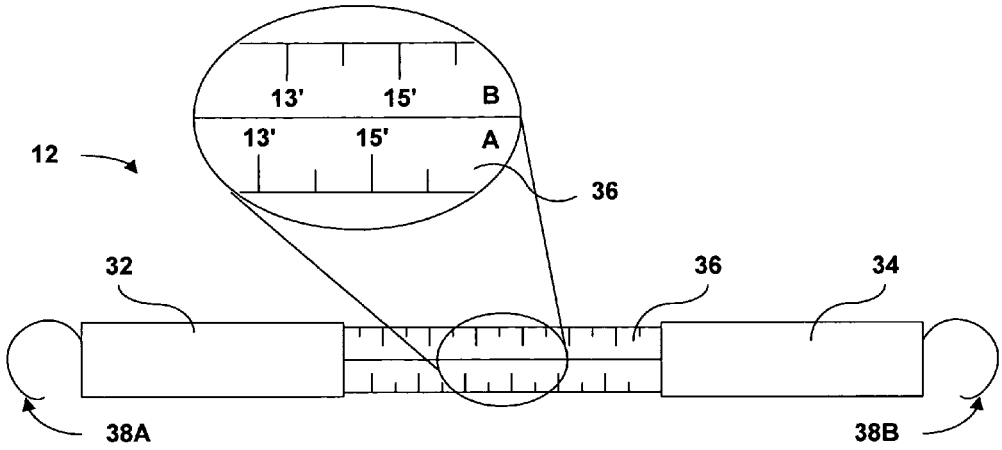
FIG. 3 is a schematic diagram illustrating a temporary spacer used to construct the geometries of a geodesic dome structure.

FIG. 3 is a schematic diagram illustrating an exemplary temporary spacer 12 used to construct the geometries of a geodesic dome structure 10. Temporary spacer 12 comprises a variable spacer that can be adjusted to create variable spacers of different lengths, such as temporary spacers 12A and 12B from FIG. 1, to define the geometries of a geodesic dome. Variable spacer 12 may be adjusted depending on a diameter or radius of a desired geodesic dome. The length of spacer 12 may be fixed once the appropriate length has been determined for the geodesic dome being constructed. Variable spacer 12 may be constructed of a rigid, yet lightweight material such as plastic.

Variable spacer 12 includes a fixed housing portion 32, a calibrated portion 36, and a moveable housing portion 34 that accepts calibrated portion 36 to allow variable spacer 12 to be adjusted to different lengths. In other embodiments, both housing portions may be moveable over the calibrated portion. Each end of variable spacer 12, i.e., the end of fixed housing portion 32 and moveable housing portion 34, includes fasteners 38A and 38B ("fasteners 38") to couple variable spacer 12 to a connector, such as connector 14B illustrated in FIGS. 2A-2C. In the illustrated embodiment, fasteners 38 may comprise hook-shaped mechanisms for effectively coupling variable spacer 12 to a connector. However, fasteners 38 may comprise screws, bolts, nails, clamps, or the like to fasten variable spacer 12 to a connector. Fasteners 38 may also easily release variable spacer 12 from a connector to facilitate a quick disengagement of variable spacer 12 from geodesic dome structure 10.

Variable spacer 12 may have a tubular shape. The radius of calibrated portion 36 may be smaller than moveable housing portion 34 such that movable housing portion 34 may slide over calibrated portion 36 to extend the length of variable spacer 12. In some embodiments, calibrated portion 36 and housing portions 32, 34 may be flat, rectangular, or any other shape as long as movable housing portion 34 moves over calibrated portion 36.

Calibrated portion 36 may include settings for easy adjustment of variable spacer 12 to particular lengths. For example, calibrated portion 36 may include settings that correspond to geodesic domes of varying radii. In this manner, movable housing portion 34 slides over calibrated portion 36 to a setting in accordance with the radius of a desired geodesic dome. The settings may correspond to other factors including diameter, circumference, or the like.

Calibrated portion 36 may further include multiple setting scales for adjustment of variable spacer 12. The multiple setting scales may be used in order to adjust variable spacer 12 for geodesic dome structures that require more than one length spacer. Both of the setting scales may be calibrated to correspond to geodesic domes of varying radii, diameter, circumference or the like. The setting scales may further be coded by color or symbol.

Figure 4:
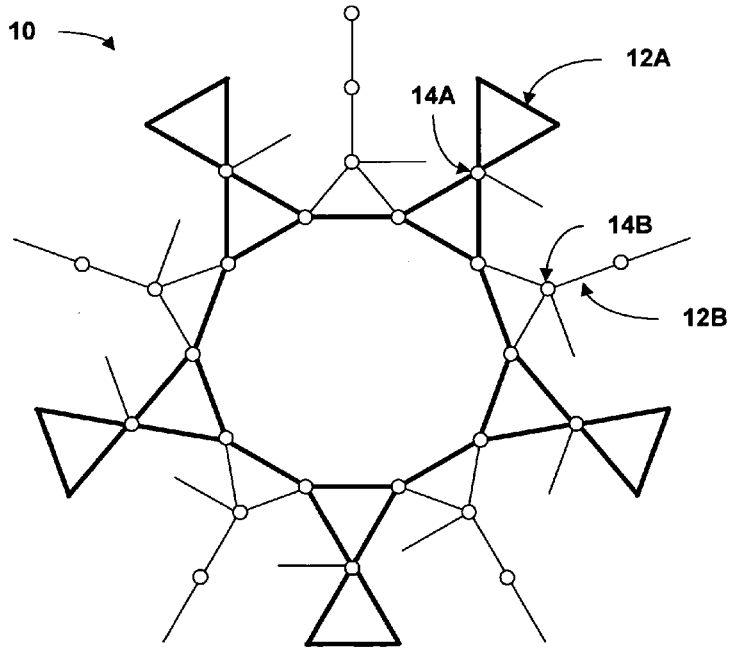
FIG. 4 is a schematic diagram illustrating a plan view of the temporary spacers shown in FIG. 3 arranged on a flat surface to illustrate the relation between the spacers before the spacers are collectively joined to create the geometries of a geodesic dome in space.

FIG. 4 is a schematic diagram illustrating a plan view of temporary spacers 12 (FIG. 1) arranged on a flat surface to illustrate the relation between the spacers before the spacers are collectively joined to create the geometries of a geodesic dome 10 in space. In particular, the plan view illustrates the relation of temporary spacers 12 with respect to one another. The structure of geodesic dome 10 is created using a set of connectors 14A, 14B, a plurality of temporary spacers 12A and a plurality of temporary spacers 12B. Spacers 12A (illustrated as bold lines) define a first length. Spacers 12B (illustrated as thin lines) define a second length different from the first length defined by spacers 12A. Spacers 12 comprise variable spacers as illustrated in FIG. 3. It should be noted that FIG. 4 is not drawn to scale. For example, all of spacers 12A are of the same length, as are spacers 12B.

Figure 5:
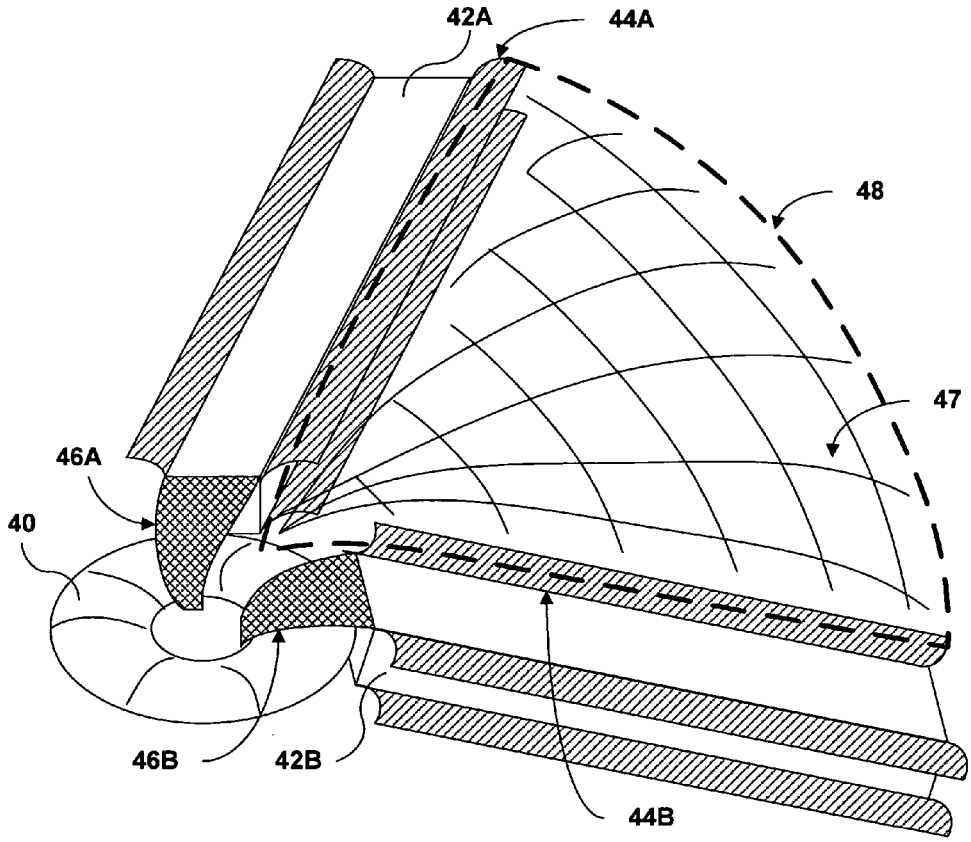
FIG. 5 is a schematic diagram illustrating a panel fastened to permanent structure members to enclose a geodesic dome structure.

FIG. 5 is a schematic diagram illustrating a panel 48 fastened to permanent structure members 42A, 42B (collectively, "permanent structure members 42") to enclose a geodesic dome structure. Permanent structure members may be fastened to a set of connectors to form a permanent geodesic dome structure based on the placement of the set of connectors defined by a set of temporary spacers. The temporary spacers may be removed once the permanent structure members are attached to the connectors.

Permanent structure members 42A and 42B are fastened to a connector 40 by fasteners 46A and 46B, respectively. In the illustrated embodiment, permanent structure members 42 take the form of rectangular struts. The permanent structure members may take any form that provides permanent structural support to the geodesic dome structure. Permanent structure members 42 may be constructed from materials such as wood, plastic, metal, cable, fiberglass, or other material. In the illustrated embodiment, fasteners 46A, 46B comprise hooks that attach permanent structure members 42 to connector 40 via an opening in connector 40. In other words, fasteners 46A, 46B conform to the contoured surface of connector 40 in this example, and may have a degree of elasticity to essentially clamp or grip the connector. In other embodiments, fasteners 46A, 46B may comprise screws, bolts, nails, clamps, or the like.

Panel 48 may be made of weatherproof material, such as plastic, fiberglass, treated wood, metal, resin, or the like. Panel 48 comprises a contour based on a large diameter relative to a diameter of the geodesic dome structure. The contour of panel 48 may be determined from a surface of a very large dome structure such that panel 48 appears almost flat, but retains the strength of a dome. Deriving panel 48 from a geodesic dome structure of great radius and chord frequency creates an inherently stable panel that is resistant to deflection. Panel 48 may be treated with plastic, insulation, fiberglass, or other treatments to enhance its structural rigidity, integrity, strength and/or insulative properties. The treatments may be applied to an interior side of panel 48. The contour of panel 48 may depend on the geometries of the geodesic dome, such as diameter, circumference, or the like.

Panel 48 may be inscribed on one side with a high frequency chord pattern 47 such that panel 48 may be generated as a flat sheet and then drawn into a slight spherical contour. For purposes of illustration, pattern 47 does not appear as a high frequency pattern in FIG. 5. However, panel 48 may comprise a pattern with great enough frequency to generate substantially short chords with lengths of 1 to 2 inches, for example. The chord pattern 47 may be inscribed in panel 48 by one of stamping, printing, embossing, etching, photoengraving, photocopying, or the like. In this way, panel 48 may be transported flat and drawn into a contoured panel by folding along the inscribed chord pattern.

Panel 48 encloses the geodesic dome by fastening a first edge to a flange 44A, which is attached to permanent structure member 42A, and fastening a second edge to a flange 44B, which is attached to permanent structure member 42B. As illustrated, flanges 44 comprise a curvature to match the contour of panel 48. In some embodiments, flanges 44 may pivot about permanent structure members 42 to accommodate various sizes and curvatures of panel 48. Matching the curvature of flanges 44 to the contour of panel 48 provides a continuous curve between panel 48 and flanges 44, which creates a weather tight seal against wind and precipitation.

Flange 44A is attached to a first side of permanent structure member 42A proximate an exterior face of member 42A. A flange is also attached to a second side of member 42A near the exterior face to receive an edge of another panel. As described in more detail below, additional flanges may be attached to both the first and second sides of permanent structure member 42A near an interior face of member 42A. Permanent structure member 42B also includes additional flanges attached proximate an interior face of member 42B. In that case, panel 48 may be considered an exterior panel and a second, interior panel may be fastened between members 42A and 42B.

Figure 6:
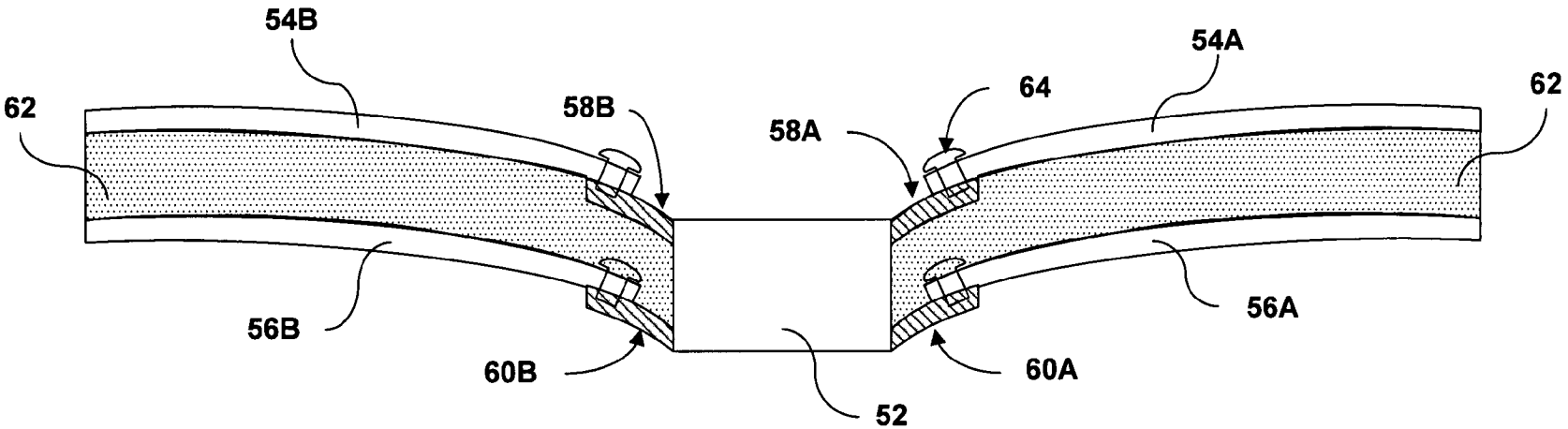
FIG. 6 is a schematic diagram illustrating a cross section of a permanent structure member and panels fastened to the permanent structure member.

FIG. 6 is a schematic diagram illustrating a cross section of a permanent structure member 52 and panels fastened to permanent structure member 52. A first flange 58A and a second flange 58B are attached to member 52 proximate an exterior face of member 52. A third flange 60A and a fourth flange 60B are attached proximate an interior face of member 52. Exterior panels 54A and 54B are fastened to first flange 58A and second flange 58B, respectively. Interior panels 56A and 56B are fastened to third flange 60A and fourth flange 60B, respectively. The panels are fastened to the flanges by fasteners 64, which may comprise at-least one of screws, bolts, nails, clamps, rivets, and adhesives. In some embodiments, the panels may be attached to the flanges in a way that allows the panels to move independent of the flanges in order to accommodate expansion and contraction of the material due to changes in temperature and pressure.

Exterior panels 54 form the exterior surface of a geodesic dome structure and interior panels 56 form the interior surface of the dome. Exterior panels 54 may comprise a treatment that improves structural integrity to withstand weather related effects. Interior panels 56 may comprise a treatment that improves aesthetics within the geodesic dome.

An insulating material 62 may be placed in a cavity created between the exterior panels 54 and the interior panels 56. Including insulating material 62 between panels 54 and 56 may form a strong, weather proof, and fire proof permanent geodesic dome structure. Insulating material 62 may comprise a pre-molded piece of foam or plastic insulation. Insulating material 62 may also comprise fiberglass insulation sprayed between the exterior and interior panels. In some embodiments, no insulating material is included and the space created between the exterior and interior panels remains open. In other embodiments, a stiffening material may be placed in the cavity to add structural support to the geodesic dome.

Figure 7:
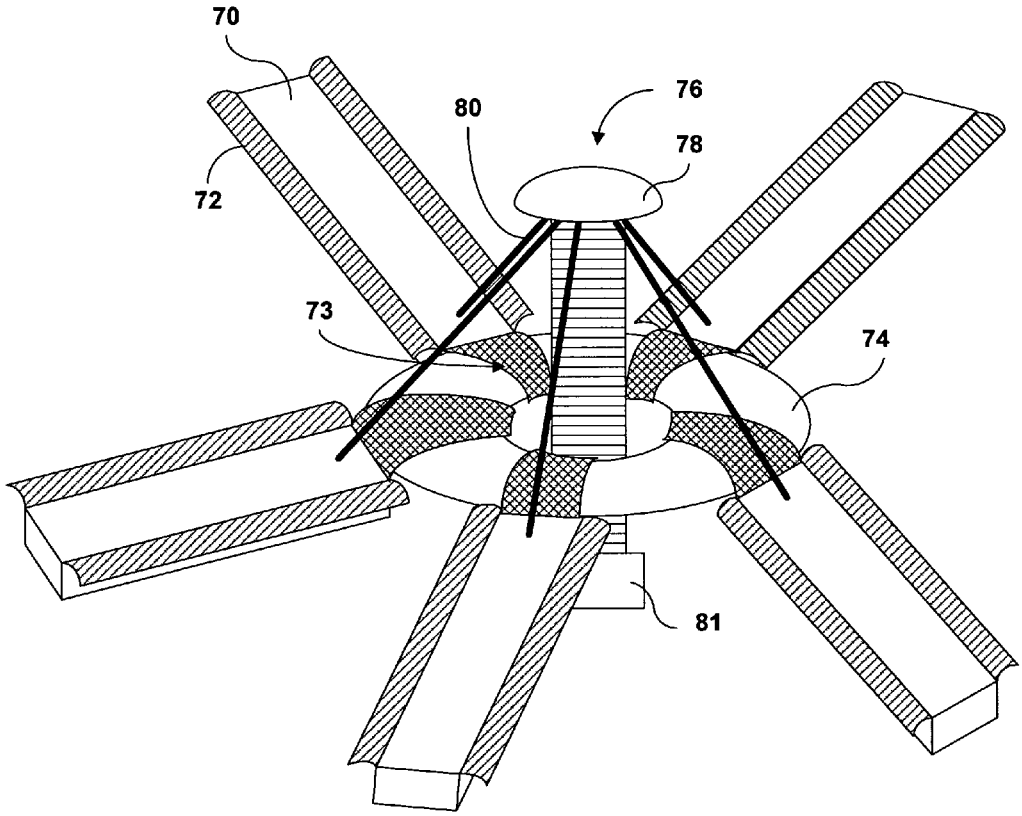
FIG. 7 is a schematic diagram illustrating a fastener used to fasten permanent structure members to a connector.

FIG. 7 is a schematic diagram illustrating an exemplary fastener 76 used to fasten permanent structure members 70 to a connector 74. In the illustrated embodiment, fastener 76 includes a bolt 78, prongs 80, and a nut 81. Bolt 78 is capable of fitting through an opening in a connector 74. Prongs 80, attached to bolt 78, connect to permanent structure members 70 to fasten members 70 to connector 74. Nut 81 may be tightened to secure members 70 to connector 74 permanently. In the illustrated embodiment, fastener 76 includes five prongs 80 to fasten five permanent structure members 70 to connector 74. In some embodiments, a bolt may include any number of prongs to fasten an appropriate number of structure members to a connector to form a geodesic dome. In other embodiments, permanent structure members may be fastened to a connector by any fastener that provides a strong and permanent attachment.

As shown in FIG. 7, permanent structure members 70 may also be attached to connector 74 by hooks 73 or another type of fastener. Hooks 73 may provide stability when initially fastening permanent structure members 70 to connector 74. Fastener 76 may be used once the geodesic dome structure has been fully assembled by permanent structure members 70 to provide a more secure attachment to connector 74.

Figure 8:
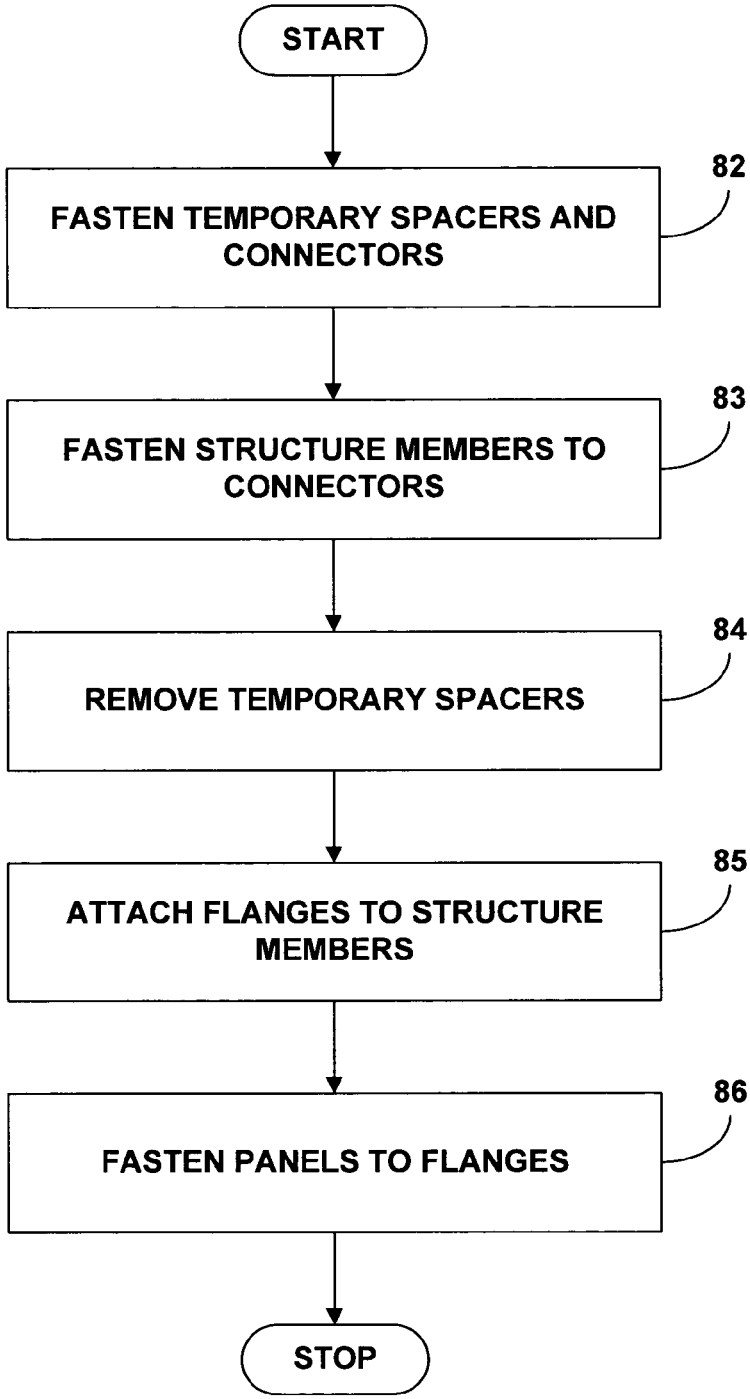
FIG. 8 is a flow chart illustrating the construction of a geodesic dome structure.

FIG. 8 is a flow chart illustrating one exemplary process for construction of a geodesic dome structure in accordance with the techniques described herein. For exemplary purposes, the process will be described in reference to geodesic dome structure 10 of FIG. 1.

Initially, a set of temporary spacers 12 is fastened to a set of connectors 14 to reference connectors 14 in space relative to one another (82). Connectors 14 and temporary spacers 12 form the geometries of geodesic dome structure 10. Temporary spacers 12 may be fastened to connectors 14 using hooks, bolts, screws, nails, clamps, or the like. Temporary spacers 12 may be fastened to connectors 14 beginning from a tier nearest the ground and building upwards. Alternatively, temporary spacers 12 may be fastened to connectors 14 beginning with a top tier and building downwards. Geodesic dome structure 10 formed by connectors 14 and temporary spacers 12 may be sturdy enough to stand freely.

Once temporary spacers 12 and connectors 14 form the geometries of geodesic dome structure 10, permanent structure members 42 may be fastened to connectors 14 to make geodesic dome structure 10 permanent (83). Permanent structure members 42 may be fastened to connectors 14 using hooks, bolts, screws, nails, clamps or the like. As with temporary spacers 12, structure members 42 may be fastened to connectors 14 beginning from a tier nearest the ground and building upward or from a top tier and building downward.

Temporary spacers 12 may be removed as permanent structure members 42 are fastened to connectors 14 (84). For example, after fastening one of permanent structure members 42 to connectors 14 along one of spacers 12, spacer 12 may optionally be removed. However, temporary spacers 12 may remain in place until all of permanent structure members 42 are fastened to connectors 14 and then temporary spacers 12 may be removed. Temporary spacers 12, once removed, may be discarded. Alternatively, the removed temporary spacers 12 may be used to reference another set of connectors 14 to form the geometries of another geodesic dome 10. In this fashion, the construction of geodesic dome structures may be done in an assembly line fashion. However, spacers 12 may remain fastened to connectors 14 and become a passive part of geodesic dome 10.

Flanges 44 are attached to permanent structure members 42 (85) to receive panels 48. Flanges 44 comprise a curvature that matches a contour of panels 48 to provide a continuous curve between flanges 44 and panels 48. Flanges 44 may be attached to permanent structure members 42 proximate an exterior face of members 42 and/or proximate an interior face of members 42. Flanges 44 may be attached by fasteners such as bolts, screws, nails, clamps or the like Panels 48 are fastened to permanent structure members 46 and connectors 14 to enclose geodesic dome structure 10 (86). Panels 48 comprise a contour based on a large diameter relative to the diameter of geodesic dome 10. Panels 48 may be fastened to connectors 14, to permanent structure members 42, or both. Panels 48 may be fastened to connectors 14 in the same fashion as attaching structure members 42 to connectors 14. Panels 48 may be fastened to permanent structure members 42 using fasteners such as bolts, screws, nails, clamps or the like. Instead, panels 48 may be constructed with grooves, which receive structure members 42. Panels 48 may be fastened to flanges 44, which are attached to permanent structure members 42. Panels 48 may be made of weatherproof material such as plastic, fiberglass, treated wood, metal, or the like. In some embodiments, exterior and interior panels may be fastened to flanges 44. In that case, insulating material may be included between the sets of panels.

Temporary spacers 12, connectors 14, permanent structure members 42, flanges 44, and panels 48 may come in a kit. The kit may come with spacers 12, connectors 14, permanent structure members 42, flanges 44, and panels 48 coded by color and/or symbol in order to aid in the construction. The kit and construction method provide a way of constructing livable geodesic structures in a matter of hours, and with little manual labor. It may be useful for providing shelter for those who have lost homes from natural disasters, wars, or the like. However, the geodesic dome structures may have alternative uses such as an advertising billboard or decoration. Temporary spacers 12 and other components may also be manufactured to extremely small tolerances, thus assuring the completed domes will approach the theoretical geometries of the desired dome, in turn, increasing the stability of the dome. The fine precision in manufacturing the components of the dome also promotes ease of assembly.

Figure 9:
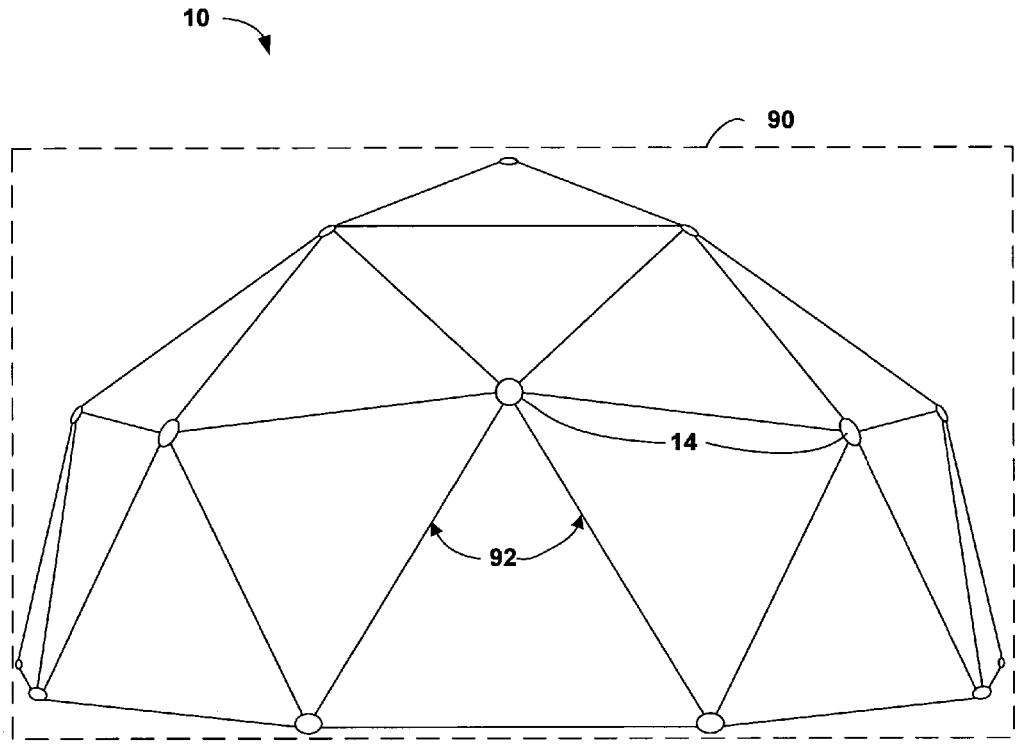
FIG. 9 is a schematic diagram illustrating an erected wire mesh that references a plurality of connectors with respect to one another in space to form the geometries of a geodesic dome.

FIG. 9 is a schematic diagram illustrating an erected wire mesh 90 that references a plurality of connectors 14 with respect to one another in space to form the geometries of a geodesic dome 10. In the embodiment shown in FIG. 1, temporary spacers 12 were used to reference connectors 14. In the embodiment shown in FIG. 9, a plurality of strands of woven wire 92 is attached between each of connectors 14 to create a wire mesh 90. In this manner, the strands of woven wire act as temporary spacers. Wire mesh 90 may be used to reference connectors 14. Strands of wire 92 may be pre-cut to the proper lengths. Alternatively, strands of wire 92 may need to be cut to proper lengths during the construction process. Strands of wire 92 attached to connectors 14 form wire mesh 90. In order to reference connectors 14 with respect to one another in space, wire mesh 90 may be erected. Temporary support platforms, a crane or the like may be used to erect wire mesh 90. The wire strands may be constructed of flexible material such as nylon.

Alternatively, temporary variable spacers 12 (FIG. 3) may be attached to connector 14 using the strands of wire 92 as guides for rapid attachment of spacers 12 to connectors 14. The assembly of successive tiers of temporary spacer 12 and connectors 14 will support wire mesh 90 to generate the geometries of geodesic dome 10. Once wire mesh 90 is fully supported, permanent structure members 42 may be fastened to connectors 14 and temporary spacers 12 may be removed.

Figure 10:
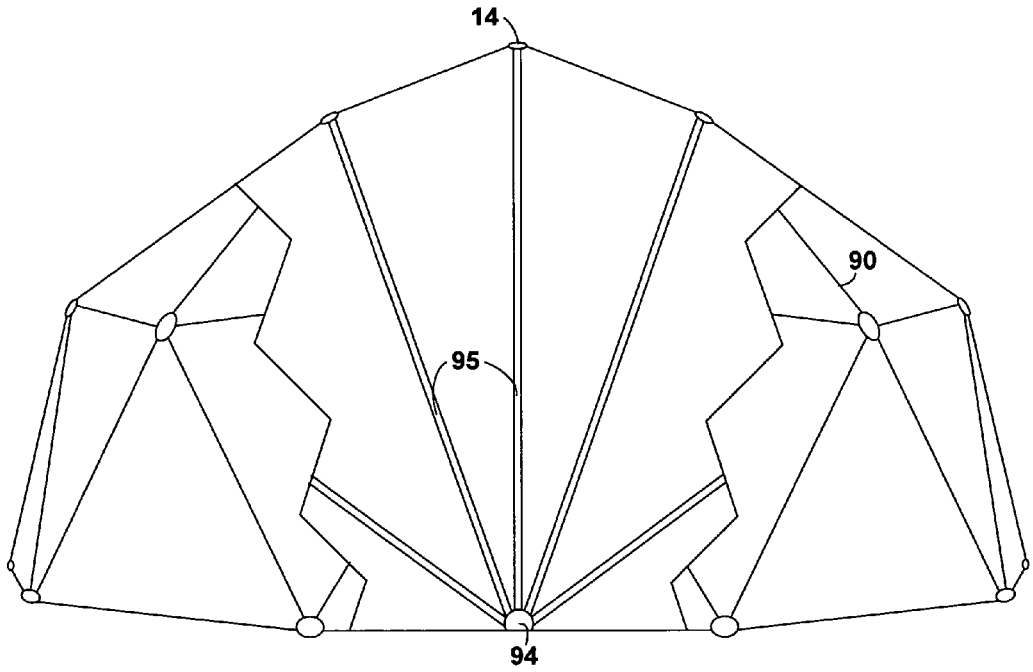
FIG. 10 is a schematic diagram illustrating an internal view of the wire mesh of FIG. 9.

FIG. 10 is a schematic diagram illustrating an internal view of the wire mesh 90 of FIG. 9 being erected using a temporary support platform 94. Temporary support platform 94 has a plurality of temporary beams 95 that extend from platform 94 to connectors 14. Each connector 14 of the mesh 90 is erected by one of beams 95. Instead of all of beams 95 being collected at platform 94, each of beams 95 may extend from corresponding connector 14 straight to the ground. Beams 95 may be constructed of wood, steel, plastic, or the like.

Figure 11:
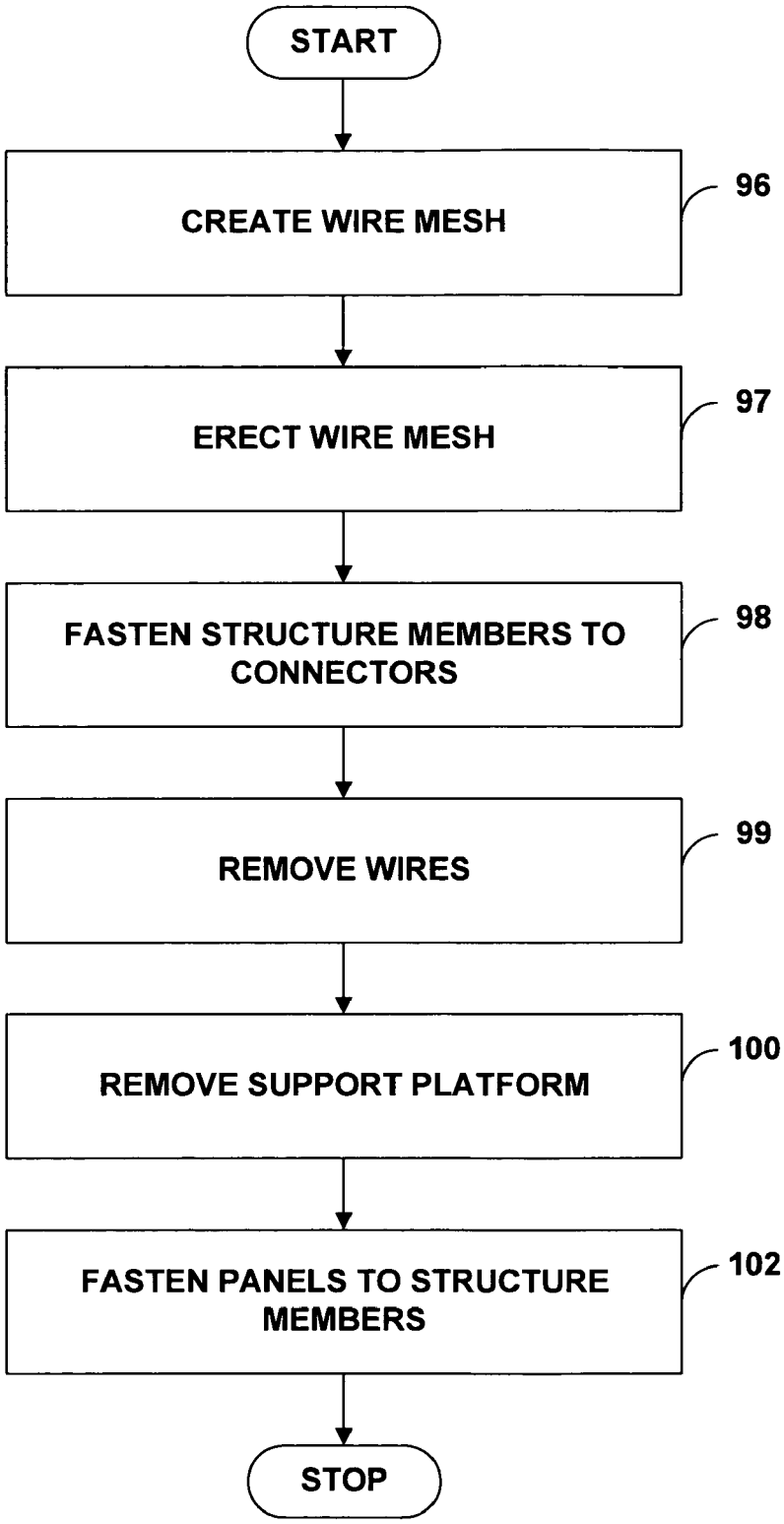
FIG. 11 is a flow chart illustrating the construction of a geodesic dome using wire mesh.

FIG. 11 is a flow chart illustrating the construction of geodesic dome 10 using wire mesh 90. A strand of woven wire 92 is attached between each of connectors 14 and its neighboring connectors 14 to create a wire mesh 90 (96). In this manner, the strands of woven wire act as the temporary spacers. Strands of wire 92 may be pre-cut to the proper lengths. Alternatively, strands of wire 92 may need to be cut to appropriate lengths during the construction process. Furthermore, a single strand of wire 92 may be attached between two or more connectors 14. In fact, one strand of wire may attach to all of connectors 14.

Wire mesh 90 may be erected to form the geometries of geodesic dome 10 (97). Once erected, wire mesh 90 references connectors 14 with respect to one another to form the geometries of geodesic dome 10. Wire mesh 90 may be erected in numerous fashions, including using temporary support platform 94, using a crane or the like.

Permanent structure members 42 (FIG. 5) may be fastened to connectors 14 of wire mesh 90 to form the permanent structure of geodesic dome 10 (98). Permanent structure members 42 may be placed on top of or under each strand of wire 92. As permanent structure members are being placed, wires 92 may be removed (99). Alternatively, the entire wire mesh 90 may be removed at the same time. However, wires 92 may remain as a passive component of geodesic dome 10. Beams 95 of temporary support platform 94 may also be removed as permanent structure members 42 are being fastened to connectors 14 (100). Alternatively, temporary beams 95 may be kept in place until all permanent structure members 42 are in place.

Panels 48 (FIG. 5) are fastened to permanent structure members 42 and connectors 14 to enclose geodesic dome structure 10 (102). The panels 48 comprise a contour based on a large diameter relative to the diameter of geodesic dome 10. The contour may be slightly spherical. Panels 48 may be fastened to connectors 14, to permanent structure members 42, or both. The panels 48 may be fastened to connectors 14 in the same fashion as attaching structure members 42 to connectors 14. Panels 48 may be fastened to permanent structure members 42 using fasteners such as bolts, screws, nails, clamps, or the like. Instead, panels 48 may be constructed with grooves, which receive structure members 42. In some cases, the panels 48 may be fastened to flanges 44, which are attached to permanent structure members 42. The flanges 44 may comprise a curvature to match the contour of panels 48 to provide a continuous curve between the flanges 44 and the panels 48. Panels 48 may be made of weatherproof material such as plastic, fiberglass, treated wood, metal, or the like.

The materials used to construct geodesic dome 10 may come as a kit. The kit may include connectors 14 with wires 92 already attached. However, the kit may come with no pre-assembly of materials. The materials may be coded by color and/or symbol to aid in construction.

Figure 12:
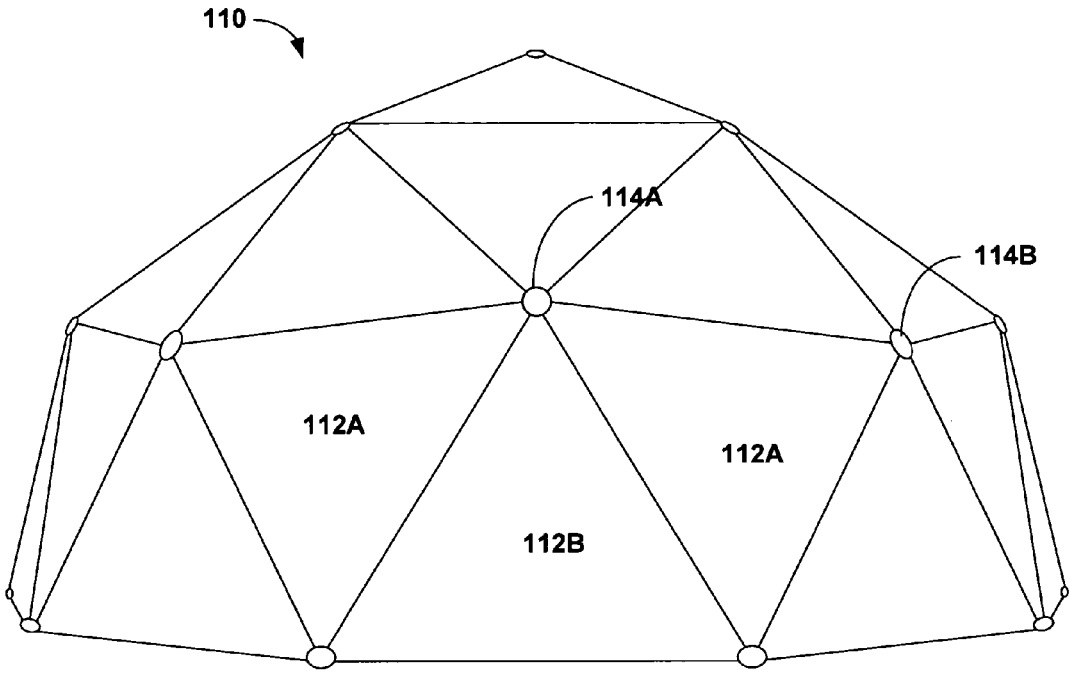
FIG. 12 is a schematic diagram illustrating another set of connectors referenced with respect to one another in space by another set of temporary spacers to form the geometries of a geodesic dome structure.

FIG. 12 is a schematic diagram illustrating another set of connectors 114 referenced with respect to one another in space to form the geometries of a geodesic dome structure 110. A set of temporary spacers 112 is fastened to a set of connectors 114 to reference connectors 114 with respect to one another in space, forming the geometries of geodesic dome 110. Temporary spacers 112 may be fastened to connectors 114 with fasteners such as hooks, screws, bolts, nails, clamps, or the like.

Temporary spacers 112 may be constructed of a rigid, yet lightweight material such as plastic, metal, wood, Styrofoam, or the like. In the embodiment shown in FIG. 12, temporary spacers 112 are formed in the shape of triangles. However, temporary spacers 112 may be formed in the shape of any polygon or other shape that will define and hold the geometries in space until the desired geometries are fixed permanently in space. All temporary spacers 112 of geodesic dome structure 110 need not be the same size. For example, temporary spacers 112A may take the shape of isosceles triangles, whereas temporary spacers 112B may take the shape of equilateral triangles.

Connectors 114 are constructed from materials such as metal, plastic, or the like. Connectors 114 may be constructed to fasten to any number of temporary spacers 112. In the embodiment shown in FIG. 12, there are two types of connectors 114, each with a different shape. Connector 114A is a connector taking a shape similar to a hexagon, in that it fastens to six of temporary spacers 112, whereas connector 114B takes a shape similar to a pentagon. Connectors 114 may take the shape of numerous polygons depending on the number of temporary spacers 112 that fasten to connector 114. Alternatively, connectors 114 may take the shape of circles or other curved shapes. For example, connector 114 may be a ring-like piece, substantially similar to connector 14 illustrated in FIG. 2A. The vertex of temporary spacers 112 may attach to one of circular connectors 114. Spacers 112 may rotate around the connector to seek an appropriate angle between spacer 112 and connector 114.

Figure 13A:
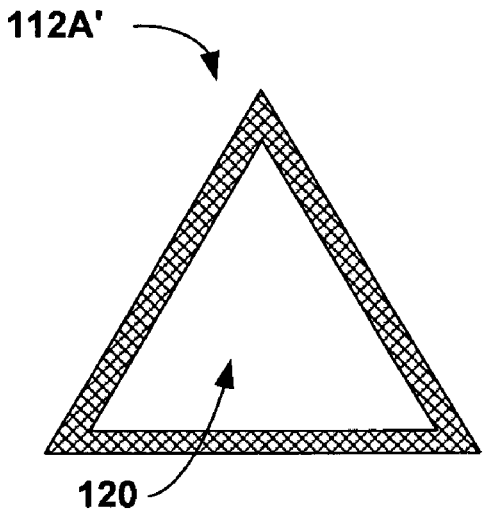
FIGS. 13A and 13B are schematic diagrams illustrating exemplary temporary spacers used to construct the geometries of a geodesic dome structure.
Figure 13B:
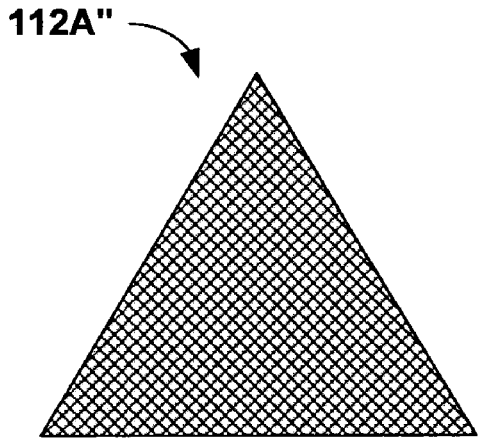

FIGS. 13A and 13B are schematic diagrams illustrating exemplary temporary spacers 112 used to construct the geometries of a geodesic dome structure 110. FIG. 13A shows a spacer 112A', which takes the shape of an isosceles triangle. The material of spacer 112A' may form an outline of a triangle, that is, the sides of spacer 112A' may form a border that creates a triangular shaped hole 120 in the center of spacer 112A'. FIG. 13B shows a spacer 112A", which also takes the shape of an isosceles triangle. Spacer 112A", unlike spacer 112A', does not form a hole 120. Instead, spacer 112A" resembles a solid sheet of material shaped like a triangle. As mentioned previously, temporary spacers 112 may take the shape of any number of polygons. Furthermore, temporary spacers 112 may be a straight piece of material, such as a temporary strut, substantially similar to spacer 12 illustrated in FIG. 3.

Figure 14A:
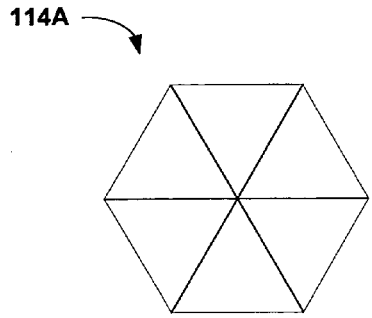
FIGS. 14A-14C are schematic diagrams illustrating an exemplary connector used to construct the geometries of a geodesic dome structure.
Figure 14B:
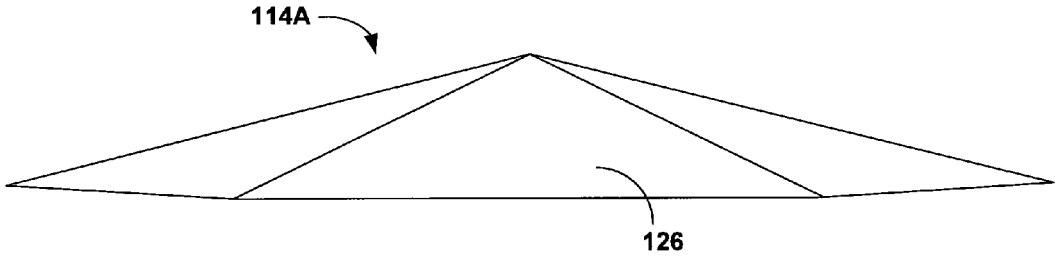
Figure 14C:
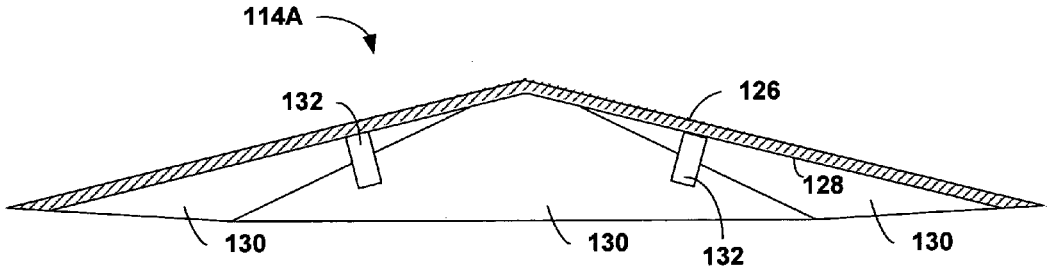

FIGS. 14A-14C are schematic diagrams illustrating an exemplary connector 114A used to construct the geometries of a geodesic dome structure 110. FIG. 14A shows a top view of connector 114A. The top view of connector 114A shows that connector 114A takes the shape of a hexagon. Connector 114A may be formed of one solid piece of material. Alternatively, connector 114A may be formed of multiple pieces of material that fit together to form connector 114A. For example, six triangular type pieces may be fastened together at appropriate angles to form connector 114A. Connector 114A may take the shape of any polygon. For example, connector 114B of FIG. 12 takes the shape of a pentagon.

FIG. 14B shows a side view of connector 114A. The side view of connector 114A shows an outer shell 126 of connector 14A, which has an angle of inclination, as opposed to being flat. The angle of inclination allows straight structures to be attached to connector 114A to form the structure of dome 110. Alternatively, connector 114A may be flat and the attaching structures may have an angle of inclination. The angle of inclination may be different depending on the shape of connector 114A. Furthermore, the angle of inclination may be different depending on the type of dome 110 that is to be constructed. For example, a dome 110 with a larger radius may have a smaller angle of inclination.

FIG. 14C shows a section view of connector 114A. Connector 114A includes an outer shell 126 and an inner shell 128. In the embodiment shown in FIG. 14C, outer shell 126 is separated from inner shell 128 by the material from which connector 114A is constructed. However, a chamber of air may separate the shells 126, 128 in order to make connector 114A lighter. Inner shell 128 of connector 114A consists of a set of triangular shaped walls 130. In the embodiment shown in FIG. 14C, inner shell 128 is constructed with six triangular shaped walls 130, three of which are shown. Each of walls 130 may have a fastening member 132 extending inward. Fastening member 132 may be a clamp, a bolt, a screw, or the like. Alternatively, each of walls 130 may have a receiving member (not shown in FIG. 14C). The receiving member would accept fastening members that may be adhered to a spacer 112, a permanent strut, a panel, or the like.

Figure 15:
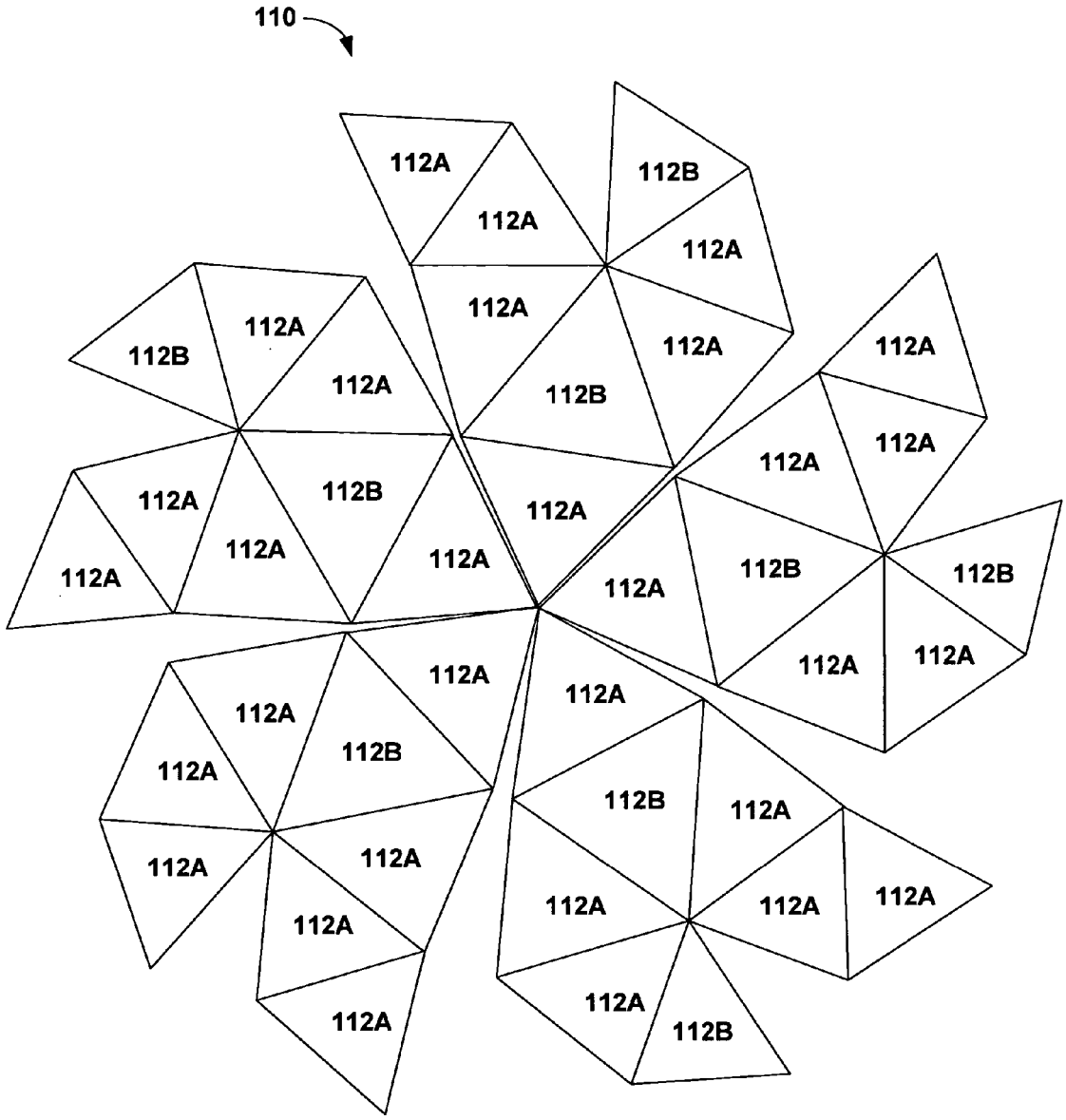
FIG. 15 is a schematic diagram illustrating a plan view of the temporary spacers shown in FIGS. 13A and 13B arranged on a flat surface to illustrate the relation between the spacers before the spacers are collectively joined to create the geometries of a geodesic dome in space.

FIG. 15 is a schematic diagram illustrating a plan view of temporary spacers 112 arranged on a flat surface to illustrate the relation between the spacers before the spacers are collectively joined to create the geometries of a geodesic dome 110 in space. The plan view illustrates the relation of temporary spacers 112 with respect to one another. The structure of geodesic dome 110 is created using a set of connectors 114A, 114B, a plurality of temporary spacers 112A and a plurality of temporary spacers 112B. Spacers 112A take the shape of isosceles triangles. Spacers 112A may have holes 120 as spacer 112A' of FIG. 13A, or be a solid sheet of material as spacer 112A" of FIG. 13B. Spacers 112B take the shape of equilateral triangles and, like spacers 112A, may have holes 120 or be a solid sheet of material. It should be noted that FIG. 15 is not drawn to scale. For example, all of spacers 112A are of the same size and shape, as are spacers 112B.

Figure 16:
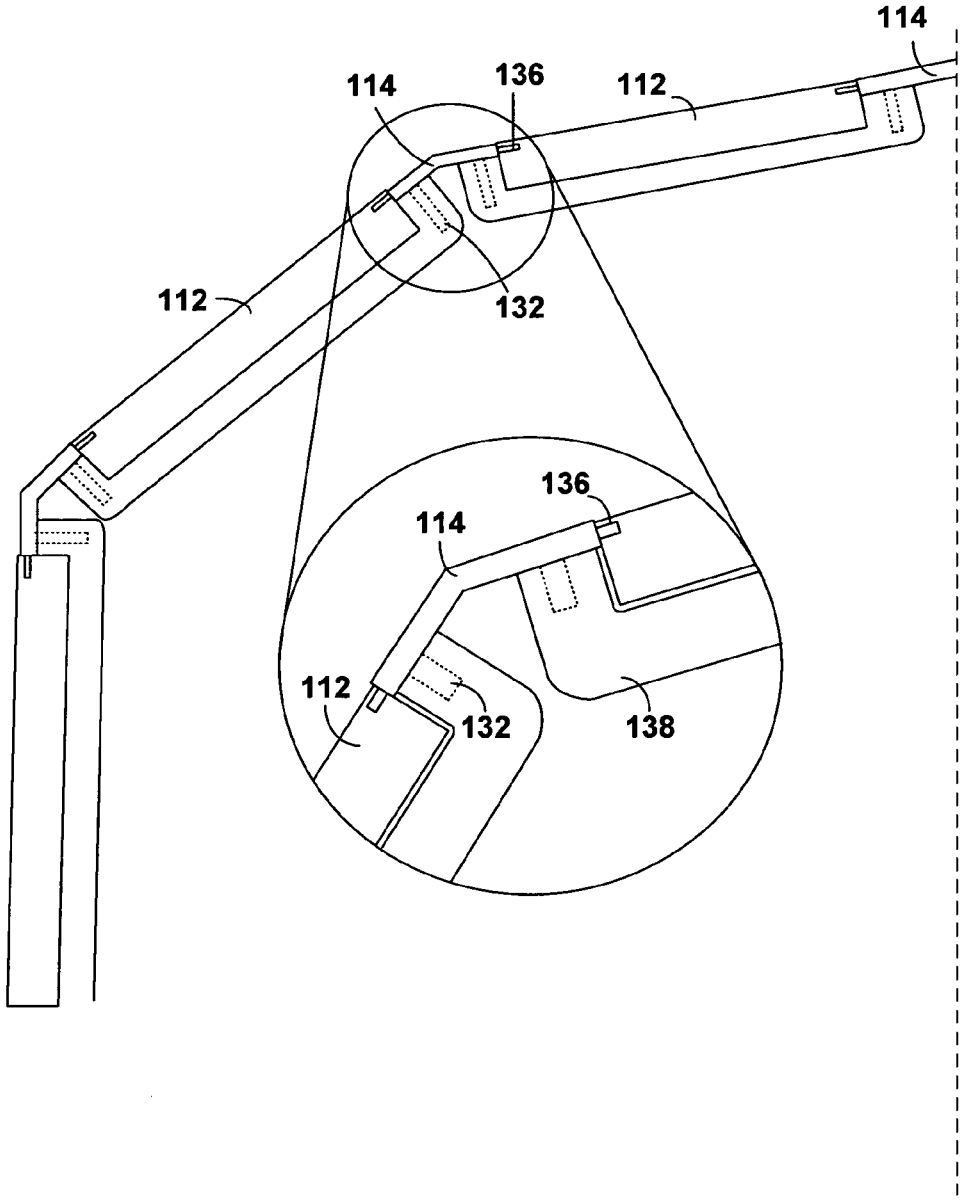
FIG. 16 is a schematic diagram illustrating a cross section of a geodesic dome structure.

FIG. 16 is a schematic diagram illustrating a cross section of a geodesic dome structure 110. Geodesic dome structure 110 comprises a plurality of temporary spacers 112 that fasten to a plurality of connectors 114 to form the geometries of geodesic dome structure 110. In the embodiment shown in FIG. 16, the geometries of dome 110 are constructed with three tiers of temporary spacers 112. Any number of tiers of temporary spacers 112 may be used depending on the size of dome 110 that is to be constructed. Each of temporary spacers 112 connects to at least one of connectors 114 via fastener 136. Fastener 136 may extend from connector 114 and be received by spacer 112. Alternatively, fastener 136 may extend from spacer 112 and be received by connector 114. Fastener 136 may not extend from either spacer 112 or connector 114, but instead may be a separate entity that fastens spacer 112 to connector 114 such as a bolt, screw, clamp, nail or the like.

Geodesic dome 110 further comprises a set of permanent structure members 138 that may be fastened to connectors 114. Permanent structure members 138 may be formed to have a receiving member (not shown in FIG. 16) to receive a fastener 132 that may extend from connector 114. Alternatively, fastener 132 may extend from permanent structure member 138 and be received by connector 114. Fastener 132 may not extend from either structure member 138 or connector 114, but instead may be a separate entity that fastens connector 114 to structure member 138, such as a bolt, screw, clamp, nail or the like. Permanent structure member 138 may be fastened to connector 114 on the outside of spacer 112. Alternatively, structure member 138 may be fastened to connector 114 on the inside of spacer 112. Permanent structure member 138 may be constructed from materials such as wood, plastic, metal, cable, fiberglass, or the like.

Figure 17:
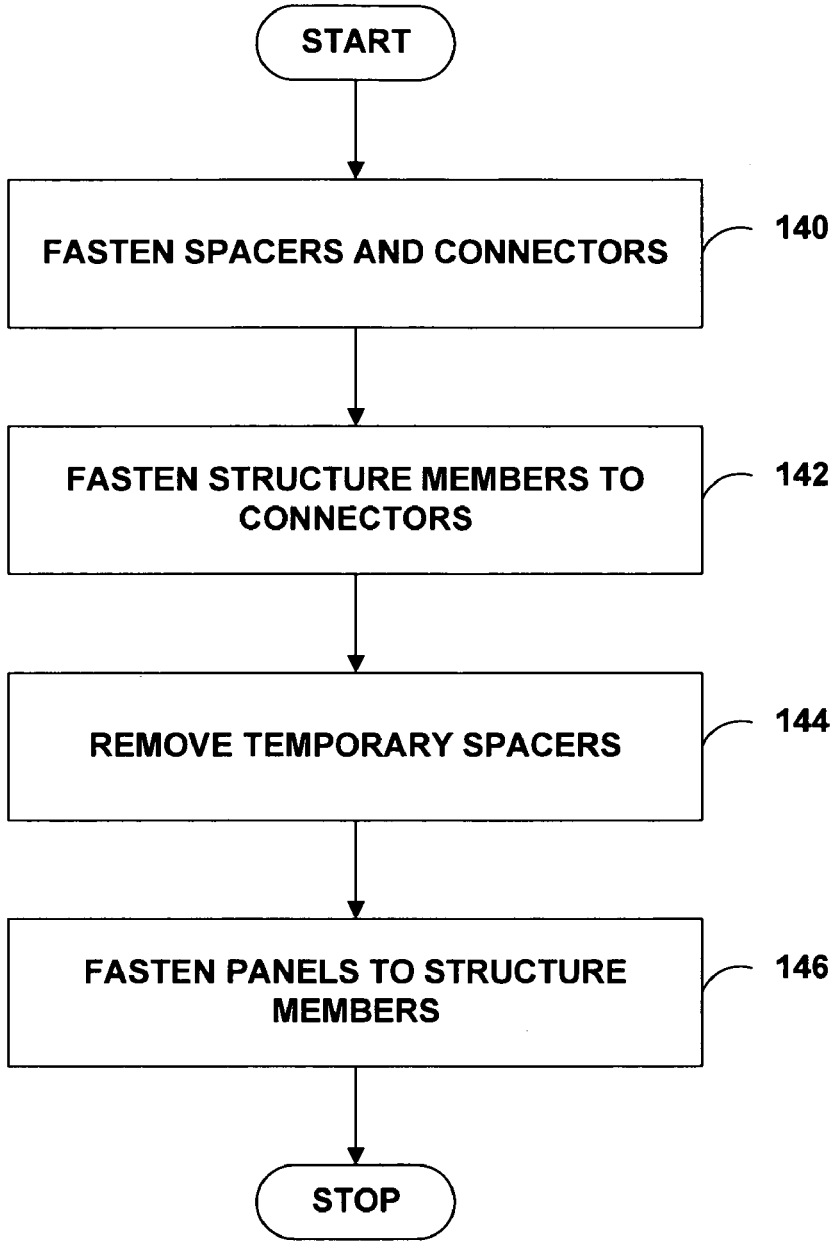
FIG. 17 is a flow chart illustrating the construction of a geodesic dome structure.

FIG. 17 is a flow chart illustrating the construction of a geodesic dome structure. A set of temporary spacers 112 is fastened to a set of connectors 114 to reference connectors 114 in space relative to one another (140). Connectors 114 and temporary spacers 112 form the geometries of geodesic dome structure 110. Temporary spacers 112 may be fastened to connectors 114 using hooks, bolts, screws, nails, clamps or the like. Temporary spacers 112 may be fastened to connectors 114 beginning from a tier nearest the ground and building upwards. Alternatively, temporary spacers 112 may be fastened to connectors 114 beginning with a top tier and building downwards. Geodesic dome structure 110 formed by connectors 114 and temporary spacers 112 may be sturdy enough to stand freely.

Once temporary spacers 112 and connectors 114 form the geometries of geodesic dome structure 110, permanent structure members 138 may be fastened to connectors 114 to make geodesic dome structure 110 permanent (142). Permanent structure members 138 may be fastened to connectors using hooks, bolts, screws, nails, clamps or the like. As mentioned above, structure members 138 may be fastened either outside or inside of spacer 112. As with temporary spacers 112, structure members 138 may be fastened to connectors 114 beginning from a tier nearest the ground and building upward or from a top tier and building downward.

Temporary spacers 112 may be removed as permanent structure members 138 are fastened to connectors 114 (144). For example, after fastening one of permanent structure members 138 to connectors 114 along each of the three sides of one of spacers 112, spacer 112 may be removed. However, temporary spacers 112 may remain in place until all of permanent structure members 138 are fastened to connectors 114 and then temporary spacers 112 may be removed. Temporary spacers 112, once removed, may be discarded. Alternatively, the removed temporary spacers 112 may be used to reference another set of connectors 114 to form the geometries of another geodesic dome 110. In this fashion, the construction of geodesic dome structures may be done in an assembly line fashion. However, spacers 112 may remain fastened to connectors 114 and become a passive part of geodesic dome 110.

Panels are fastened to permanent structure members 138 and connectors 114 to enclose geodesic dome structure 110 (146). The panels comprise a contour based on a large diameter relative to the diameter of geodesic dome 110. The contour may be slightly spherical. The panels may be fastened to connectors 114, to permanent structure members 138, or both. The panels may be fastened to connectors 114 in the same fashion as attaching structure members 138 to connectors 114. The panels may be fastened to permanent structure members 138 using fasteners such as bolts, screws, nails, clamps or the like. Instead, panels may be constructed with grooves, which receive structure members 138. In some cases, the panels may be fastened to flanges, which are attached to permanent structure members 138. The flanges may comprise a curvature to match the contour of the panels to provide a continuous curve between the flanges and the panels. The panels may be made of weatherproof material such as plastic, fiberglass, treated wood, metal, or the like. Permanent structure members 138 may, instead, be constructed in the form of a panel. In this manner, permanent structure members 138 may provide the permanence of the geodesic dome structure as well as enclose the geodesic dome structure.

Temporary spacers 112, connectors 114, permanent structure members 138, and the panels may come in a kit. The kit may come with spacers 112, connectors 114, permanent structure members 138, and the panels coded by color and/or symbol in order to aid in the construction. The kit and construction method provide a way of constructing livable geodesic structures in a matter of hours, and with little manual labor. It may be useful for providing shelter for those who have lost homes from natural disasters, wars, or the like. However, the geodesic dome structures may have alternative uses such as an advertising billboard or decoration. Temporary spacers 112 and other components may also be manufactured to extremely small tolerances, thus assuring the completed domes will approach the theoretical geometries of the desired dome, in turn, increasing the stability of the dome. The fine precision in manufacturing the components of the dome also promotes ease of assembly.

Figure 18A:
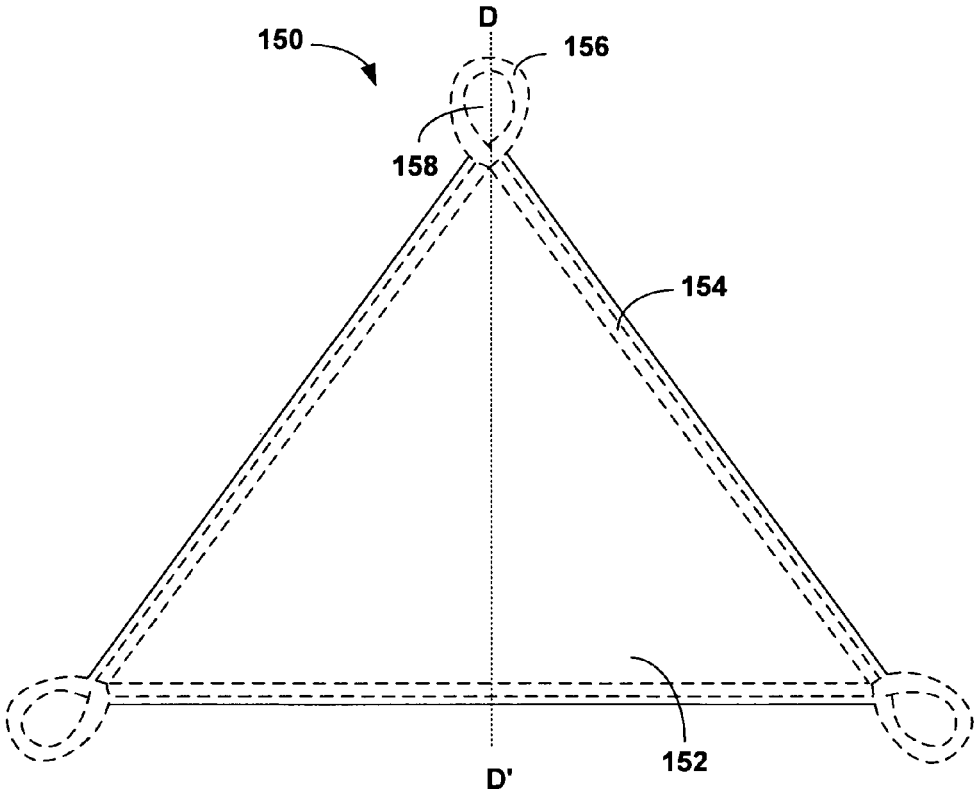
FIG. 18A is a schematic diagram illustrating a spacer that also serves as a panel structure member that references connectors with respect to one another in space as well as provides a permanent support structure of a geodesic dome and concurrently encloses the geodesic dome.

FIG. 18A is a schematic diagram illustrating a spacer 150, which also serves as a panel structure member that references the connectors with respect to one another in space as well as provides the permanent support structure of geodesic dome 110 and concurrently encloses geodesic dome 110. Spacer 150 comprises a panel 152, which has an embedded permanent structure member. In the embodiment shown in FIG. 18A, panel 152 has an embedded cable 154 that provides spacer 150 with the capacity to serve as a permanent structure member, as well as an enclosing member. Other permanent structure members, such as wood, metal, plastic or the like, may be embedded in panel 152 to provide the necessary support. Embedded cable 154 forms a loop 156 at each vertex of spacer 150. The loop 156 of embedded cable 154 creates an opening 158. Opening 158 may be used to attach spacer 150 to connector 114. Spacer 150 may be shaped like an isosceles triangle, equilateral triangle, or any other polygon. Panel 152 may be constructed of a material that is not strong enough to provide the permanence of geodesic dome 110 such as a synthetic material, a thin plastic, or the like.

Figure 18B:
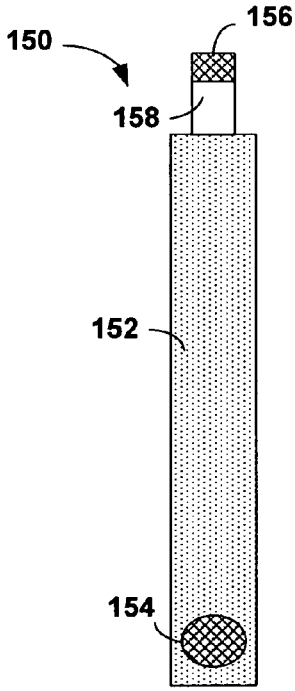
FIG. 18B is a schematic diagram illustrating a cross section view of the spacer of FIG. 18A.

FIG. 18B is a schematic diagram illustrating a cross section view of spacer 150 of FIG. 18A from D to D'. Loop 156 of embedded cable 154 creates opening 158. Opening 158 may fasten to connector 114. Cable 154 may be embedded near the edge of panel 152. Furthermore, cable 154 may be embedded elsewhere throughout panel 152.

Spacer 150 may fasten to connector 114. In the embodiment shown in FIG. 18A, opening 158 created by loop 156 of embedded cable 154 receives fastening member 132 of connector 114. Loop 156 of panel structure member 150 may be held firmly in place by the tension in the cable after each of loops 156 has been attached to corresponding connectors 114. Alternatively, an epoxy, glue, bolt, nail, or the like may aid in keeping loop 156 fastened firmly to connector 114. Furthermore, a cap may be placed on the end of fastening member 132. The cap may prevent loop 156 from sliding off the end of fastening member 132.

Using spacer 150, referencing connectors 114 in space with respect to one another, providing permanence to geodesic dome 110 and enclosing geodesic dome 110 may be done in the same step. For instance, instead of placing permanent structure members 138, removing temporary spacers 112 and attaching panels to enclose dome 110, spacer 150 may be fastened to connectors 114. Spacer 150 may reduce the number of steps in the construction process of geodesic dome 110.

Figure 19A:
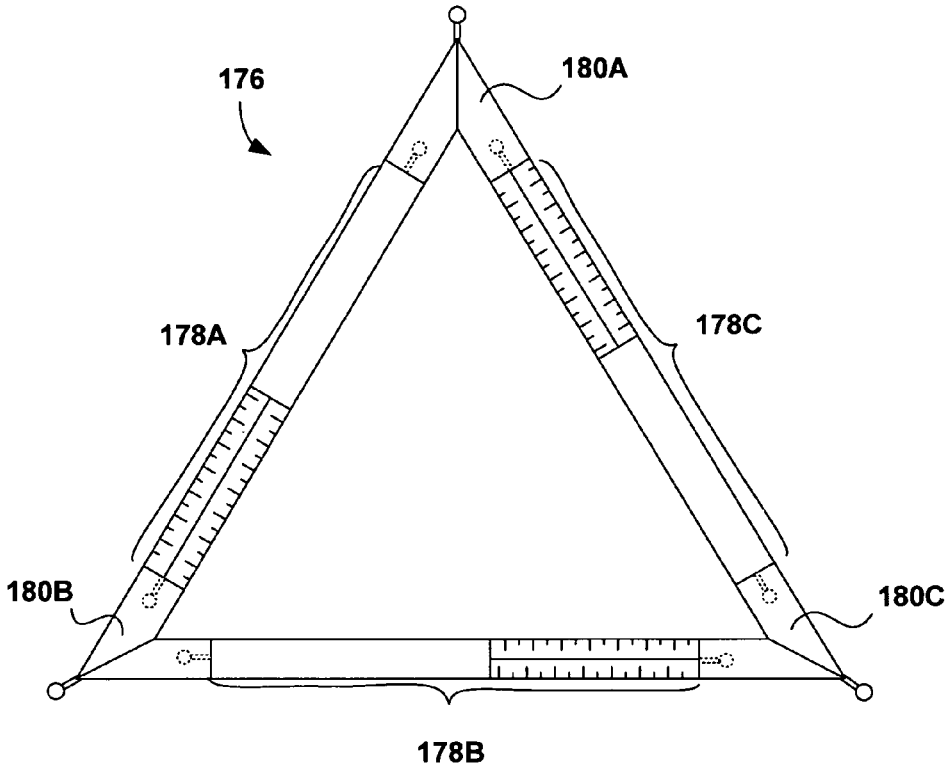
FIGS. 19A-19C are schematic diagrams illustrating a spacer that includes variable spacer arms that may be used to generate domes of various diameters.
Figure 19B:
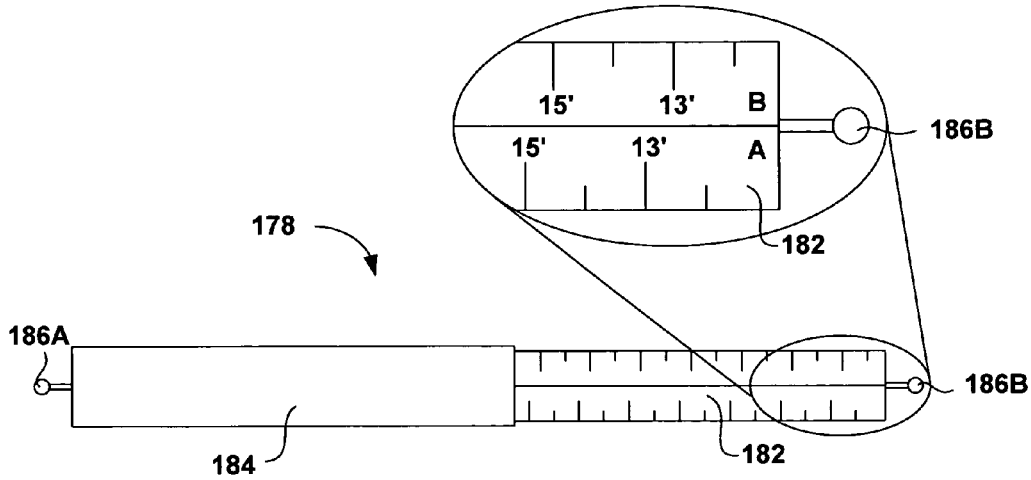
Figure 19C:
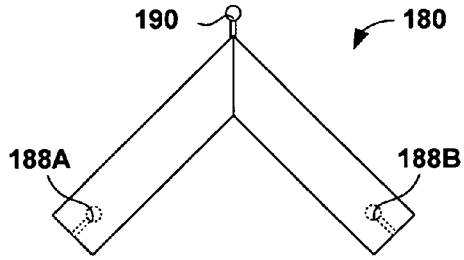

FIGS. 19A-19C are schematic diagrams illustrating another exemplary temporary spacer used to construct the geometries of a geodesic dome. FIG. 19A illustrates a variable spacer 176 constructed of variable spacer arms 178A-178C ("variable spacer arms 178") and hinges 180A-180C ("hinges 180"). More particularly, variable spacer arms 178 are adjusted to a particular length and then coupled to hinges 180 to form variable spacer 176. Variable spacer arms 178 may, for example, be adjusted depending on a diameter or radius of a desired geodesic dome.

Variable spacer 176 and variable spacer arms 178 may be constructed of a rigid, yet lightweight material such as plastic. In the embodiment shown in FIG. 19A, variable spacer 176 is formed in the shape of a triangle. However, variable spacer 176 may be formed in the shape of any polygon or other shape that will define and hold the geometries in space until the desired geometries are fixed permanently in space.

FIG. 19B illustrates one of variable spacer arms 178 in further detail. Variable spacer arm 178 includes a calibrated portion 182 to allow variable spacer arm 178 to be adjusted to different lengths and a housing portion 184 to accept calibrated portion 182. Each end of variable spacer arm 178, i.e., the end of calibration portion 182 and housing portion 184, includes fasteners 186A and 186B ("fasteners 186") to couple variable spacer arm 178 to hinges 180. Variable spacer arm 178 and, more particularly, calibrated portion 182 and housing portion 184 may have tubular shapes. The radius of calibrated portion 182 may be smaller than housing portion 184 such that calibrated portion may extend from and retract into housing portion 184. Calibrated portion 182 and housing portion 184 may take on different shapes. For example, calibrated portion 182 and housing portion 184 may be flat, rectangular, or any other shape as long as calibrated portion 182 extends from and retracts into housing portion 184. However, calibrated portion 182 need not retract into housing portion 184 as long as the length of a side and vertex angles of variable spacer 176 may be adjusted. For instance, a spacer may include a calibrated portion that may be fixed in relation to other portions of the spacer and adjusted to form spacers of different lengths.

Calibrated portion 182 may include settings for easy adjustment of variable spacer arm 178 to particular lengths. For example, calibrated portion 182 may include settings that correspond to geodesic domes of varying radii. In this manner, calibrated portion 182 extends from housing portion 184 to a setting in accordance with the radius of a desired geodesic dome. The settings may correspond to other factors including diameter, circumference, or the like.

Calibrated portion 182 may further include multiple setting scales for adjustment of variable spacer arm 178. The multiple setting scales may be used in order to adjust variable spacer arm 178 for spacers that have more than one length. For example, when adjusting calibrated portion 182 for a spacer that is shaped like an isosceles triangle, variable spacer arms 178 must be adjusted to different lengths. As illustrated in the example of FIG. 19B, calibrated portion 182 may include a first setting that corresponds to a first length, e.g., a base length of the isosceles triangle, and a second setting that corresponds to a second length, e.g., a side length of the isosceles triangle. A spacer shaped like an isosceles triangle, for example, may include two variable spacer arms adjusted using the second setting scale and one variable spacer arm adjusted using the first setting scale. Both of the setting scales may be calibrated to correspond to geodesic domes of varying radii, diameter, circumference or the like. The setting scales may further be color-coded.

FIG. 19C illustrates one of hinges 180 in further detail. Hinge 180 is shaped to form variable spacer 176 upon coupling to variable spacer arms 178. Hinge 180 includes slots 188A and 188B ("slots 188") to accept and hold fasteners 186 from variable spacer arms 178. More specifically, slot 188A accepts a fastener 186 from a first variable spacer arm 178 and slot 188B accepts a fastener 186 from as second variable spacer arm 178. Hinge 180 may further include a hook 190 to attach an assembled variable spacer 176 to other spacers at a vertex of a geodesic dome. Hinge 180 may be constructed from materials such as steel, rigid plastic, or the like.

Figure 20:
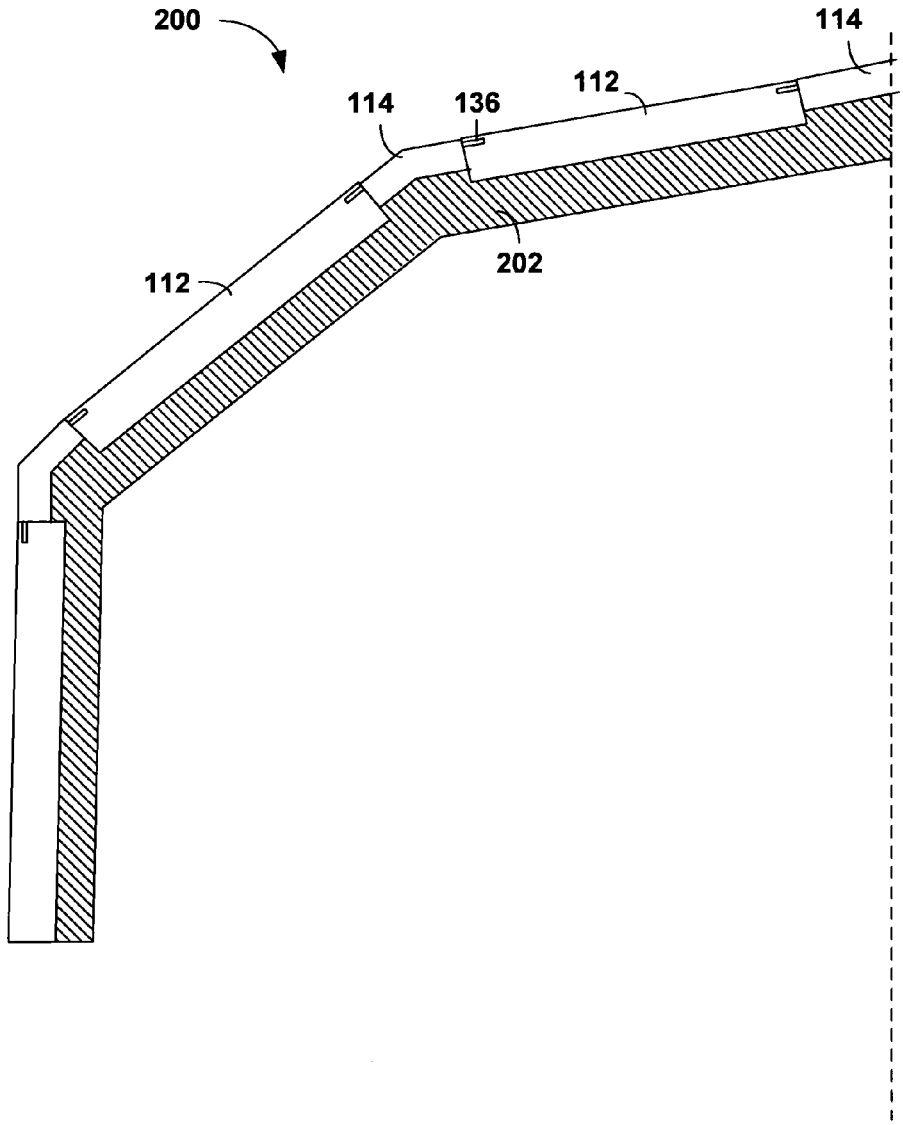
FIG. 20 is a schematic diagram illustrating a cross section view of a geodesic dome constructed using a curing material.

FIG. 20 is a schematic diagram illustrating a cross section view of a geodesic dome 200 constructed using a curing material 202. Geodesic dome structure 110 includes an outer layer that is constructed of temporary spacers 112 and connectors 114. An inner layer of geodesic dome 200 comprises curing material 202 that sets, in turn making geodesic dome 200 permanent. In this manner, curing material 202 acts as the permanent structure members. Curing material 202 may be spray-on cement, fiberglass, epoxy, or the like. The layers of geodesic dome 200 may be reversed. For example, the layer comprising spacers 112 and connectors 114 may be the inner layer, while the layer of curing material 202 may be the outer layer.

Figure 21:
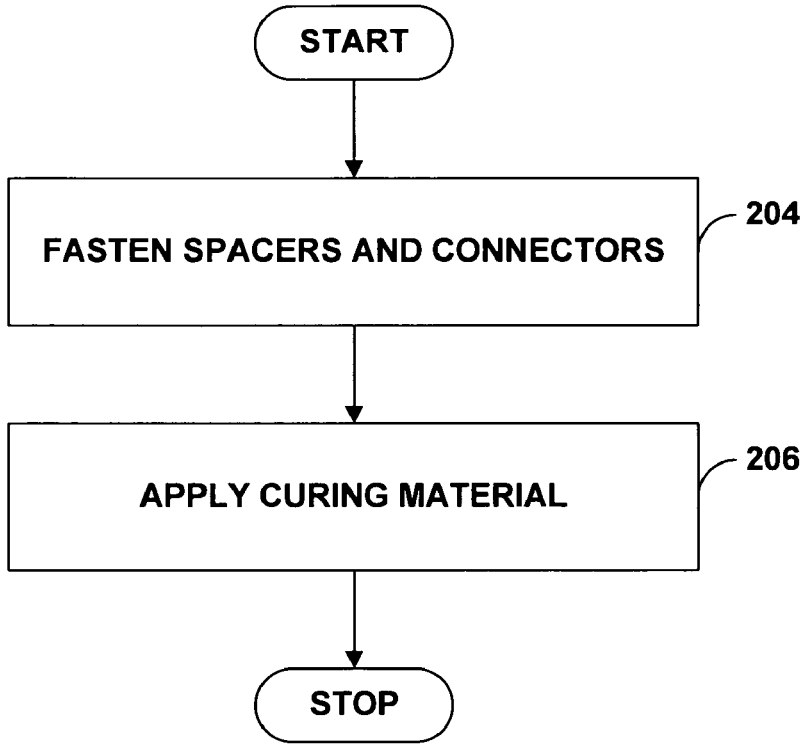
FIG. 21 is a flow chart illustrating the construction of geodesic dome of FIG. 20.

FIG. 21 is a flow chart illustrating the construction of geodesic dome 200 of FIG. 20. A set of temporary spacers 112 is fastened to a set of connectors 114 to reference connectors 114 in space relative to one another (204). Connectors 114 and temporary spacers 112 form the geometries of geodesic dome structure 110. Spacers 112 may be fastened to connectors 114 using bolts, screws, nails, clamps or the like. Spacers 112 may be fastened to connectors 114 beginning from a tier at ground level and building upwards. Alternatively, spacers 112 may be fastened to connectors 114 beginning with a top level tier and building downwards.

A curing material 202 may be applied to the geodesic dome structure 110 to provide the permanence of geodesic dome 200 (206). In this manner, curing material 202 acts as the permanent structure members. Curing material 202 may be applied to the inside of spacers 112 and connectors 114. Alternatively, curing material 202 may be applied to the outside of spacers 112 and connectors 114. In time, curing material 202 sets forming geodesic dome structure 200. In some embodiments, curing material 202 may also act as panels to enclose geodesic dome 110.

A number of embodiments of the present invention have been described. Nevertheless, it will be understood that various modifications may be made without departing from the spirit and scope of the invention. For example, permanent structure members are described above as being provided in a kit to construct a geodesic dome. However, permanent structure members may be used that are not provided in a kit. Lengths of material such as wood, plastic, metal, rolled cardboard, and the like may be fastened to the connectors in place of the prefabricated permanent structure members. Furthermore, the members may be fastened to the connectors with twine, wire, string, or the like instead of mechanical fasteners as described above. This alternative may be necessary in primitive locations or poverty stricken areas. Accordingly, other embodiments are within the scope of the following claims.

The invention claimed is:

1. An apparatus comprising:

a set of panels connected to form a geodesic dome, wherein the panels have surface contours that conform to a surface contour of another geodesic dome having a dimension larger than a dimension of the geodesic dome formed by the panels;

a set of connectors;

a set of temporary spacers comprising rod-shaped spacers that adjust to form temporary spacers of different sizes, the temporary spacers connected to the connectors to spatially define the geometries of the geodesic dome; and a set of permanent structure members that fasten to the connectors to form a permanent geodesic dome structure, wherein the set of panels fasten to the permanent structure members to enclose the permanent geodesic structure to form the geodesic dome.

2. The apparatus of claim 1, wherein the panels have a slightly spherical surface contour.

3. The apparatus of claim 1, wherein the panels are constructed from at least one of wood, plastic, metal, and fiberglass.

4. The apparatus of claim 1, wherein the set of panels connected to form the geodesic dome includes a set of exterior panels and a set of interior panels.

5. The apparatus of claim 4, further comprising insulating material placed between the exterior panels and the interior panels to insulate the geodesic dome.

6. The apparatus of claim 1, wherein the surface contours of the panels conform to a diameter of the another geodesic dome that is larger than a diameter of the geodesic dome.

7. The apparatus of claim 1, wherein each of the surface contoured panels is created from a flat panel folded along a chord pattern inscribed on one side of the flat panel.

8. The apparatus of claim 7, wherein the inscribed chord pattern comprises one of a stamped, printed, embossed, etched, photoengraved, and photocopied chord pattern on one side of the flat panel.

9. The apparatus of claim 1, further comprising a set of flanges that attach to the permanent structure members and to which the set of panels fasten.

10. The apparatus of claim 1, wherein the flanges comprise a curvature to match the surface contour of the panels.

11. The apparatus of claim 1, wherein the shape of the connectors is dependent on the number of permanent structure members that are fastened to the connector.

12. The apparatus of claim 1, wherein the connectors comprise ring-shaped connectors.

13. The apparatus of claim 1, wherein the connectors are constructed of one of metal and plastic.

14. The apparatus of claim 1, wherein the permanent structure members are constructed from at least one of wood, plastic, metal, fiberglass, and cable.

15. The apparatus of claim 1, wherein the temporary spacers farther include a set of hinges that couple to the rod-shaped spacers.

16. An apparatus comprising:

a set of panels connected to form a geodesic dome, wherein the panels have surface contours that conform to a surface contour of another geodesic dome having a dimension larger than a dimension of the geodesic dome formed by the panels;

a set of connectors;

a set of temporary spacers, the temporary spacers connected to the connectors to spatially define geometries of the geodesic dome, wherein the temporary spacers erect a wire mesh with strands of wire that extend between the connectors to define the geometries of the geodesic dome; and a set of permanent structure members that fasten to the connectors to form a permanent geodesic dome structure, wherein the set of panels fasten to the permanent structure members to enclose the permanent geodesic structure to form the geodesic dome.

17. An apparatus comprising:

a set of connectors;

a set of temporary spacers that connect to the connectors to spatially define the geometries of a geodesic dome;

a set of permanent structure members that fasten to the connectors to form a permanent geodesic dome structure;

flanges that attach to the permanent structure members, the flanges including a first flange that attaches to a first side and a second flange that attaches to a second side of the permanent structure members, the first and second flanges attached proximate an exterior face of the permanent structure members, wherein the flanges further include a third flange that attaches to the first side and a fourth flange that attaches to the second side of the permanent structure members, the third and fourth flanges attached proximate an interior face of the permanent structure members; and a set of panels that fasten to the flanges to enclose the geodesic dome structure to form the geodesic dome.

18. The apparatus of claim 17 wherein the set of panels include a set of exterior panels that fasten to the flanges attached proximate the exterior face of the permanent structure members and a set of interior panels that fasten to the flanges attached proximate the interior face of the permanent structure members.

19. The apparatus of claim 18, further comprising insulating material placed between the exterior panels and the interior panels to insulate the geodesic dome.

20. The apparatus of claim 17, wherein the panels are constructed from at least one of wood, plastic, metal, and fiberglass.

21. The apparatus of claim 17, wherein the permanent structure members are constructed from, at least one of wood, plastic: steel, fiberglass, and cable.

* * * * *